US010399097B2

(12) United States Patent
Kobayashi et al.

(10) Patent No.: US 10,399,097 B2
(45) Date of Patent: Sep. 3, 2019

(54) ELECTROSTATIC COATING DEVICE AND ELECTROSTATIC COATING METHOD

(71) Applicants: Shunya Kobayashi, Tokai (JP); Misa Murakami, Toyota (JP); Isamu Yamasaki, Toyota (JP); Hiroya Mitani, Miyoshi (JP); Hirokazu Ohta, Toyota (JP); Kengo Honma, Tokai (JP)

(72) Inventors: Shunya Kobayashi, Tokai (JP); Misa Murakami, Toyota (JP); Isamu Yamasaki, Toyota (JP); Hiroya Mitani, Miyoshi (JP); Hirokazu Ohta, Toyota (JP); Kengo Honma, Tokai (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/031,622

(22) Filed: Jul. 10, 2018

(65) Prior Publication Data

US 2018/0318856 A1 Nov. 8, 2018

Related U.S. Application Data

(62) Division of application No. 14/409,803, filed as application No. PCT/JP2013/006247 on Oct. 22, 2013, now Pat. No. 10,058,880.

(30) Foreign Application Priority Data

Dec. 26, 2012 (JP) ..... 2012-283028

(51) Int. Cl.
*B05B 5/025* (2006.01)
*B05B 5/16* (2006.01)
(Continued)

(52) U.S. Cl.
CPC ..... *B05B 5/025* (2013.01); *B05B 5/1625* (2013.01); *B05B 12/1463* (2013.01);
(Continued)

(58) Field of Classification Search
None
See application file for complete search history.

(56) References Cited

U.S. PATENT DOCUMENTS

2005/0092236 A1 5/2005 Ueno et al.
2005/0092238 A1* 5/2005 Ueno ..... B05B 5/0407 118/621
(Continued)

FOREIGN PATENT DOCUMENTS

CN 101878069 A 11/2010
EP 1 666 157 A1 6/2006
(Continued)

OTHER PUBLICATIONS

International Search Report dated Jan. 28, 2014 in PCT/JP2013/006247 filed Oct. 22, 2013.

*Primary Examiner* — Nathan T Leong
(74) *Attorney, Agent, or Firm* — Oblon, McClelland, Maier & Neustadt, L.L.P.

(57) ABSTRACT

An electrostatic coating method in which a plurality of coating materials is respectively retained in a plurality of coating-material containers in a coating material cartridge, and the coating materials are changed by a valve at the time of sending of each of the coating materials, in an electrostatic coating device, each of the coating materials is sent from the coating material cartridge to a coating machine via a common path according to the change, and multilayer coating is performed by the electrostatic coating device.

3 Claims, 12 Drawing Sheets

(51) Int. Cl.

| | |
|---|---|
| ***B05B 12/14*** | (2006.01) |
| ***B05D 1/04*** | (2006.01) |
| ***B05D 1/00*** | (2006.01) |
| ***B05D 1/02*** | (2006.01) |

(52) U.S. Cl.
CPC ..... *B05D 1/007* (2013.01); *B05D 1/02* (2013.01); *B05D 1/04* (2013.01)

(56) References Cited

U.S. PATENT DOCUMENTS

| | | | |
|---|---|---|---|
| 2006/0202067 | A1 | 9/2006 | Mitsui et al. |
| 2010/0307413 | A1 | 12/2010 | Mitsui et al. |
| 2012/0312414 | A1 | 12/2012 | Nabeshima et al. |

FOREIGN PATENT DOCUMENTS

| | | | |
|---|---|---|---|
| JP | 2002/079149 | A | 3/2002 |
| JP | 2008-100145 | A | 5/2008 |
| JP | 2011-086056 | A | 5/2011 |

* cited by examiner

ELECTROSTATIC COATING DEVICE AND ELECTROSTATIC COATING METHOD

CROSS-REFERENCE TO RELATED APPLICATIONS

The present application is a divisional of U.S. application Ser. No. 14/409,803, filed on Dec. 19, 2014, which is a National Stage Application of Application No. PCT/JP2013/006247, filed on Oct. 22, 2013, which claims priority to Japanese Patent Application No. 2012-283028, filed on Dec. 26, 2012. The entire contents of each of the above applications are hereby incorporated by reference in entirety.

TECHNICAL FIELD

The present invention relates to an electrostatic coating device and an electrostatic coating method.

BACKGROUND ART

An electrostatic coating device is known as a coating device excellent in coating efficiency of a coating material on a coating surface, smoothness of a coating film after coating, and the like. As an example of the electrostatic coating device, there is a rotary atomizing-head type coating machine. The electrostatic coating device is used for the purpose of high-quality coating such as coating of a body of an automobile.

In a coating method including electrostatic coating, a supply method of a coating material is important to efficient coating. For example, Patent Document 1 describes a method for supplying a coating material into a coating material cartridge by a charging valve including a given coating-material supply path, a branch path that branches off from the coating-material supply path, and an opening/closing valve of the coating-material supply path.

In such a charging valve, the coating-material supply path can communicate with a supply portion for supplying the coating material into the coating material cartridge. Further, the branch path branches off from the coating-material supply path in the vicinity of a communication part between the supply portion and the coating-material supply path. Further, the opening/closing valve is disposed in an upstream portion of the communication part in the coating-material supply path.

CITATION LIST

Patent Documents

Patent Document 1: Japanese Patent Application Publication No. 2011-088056 (JP 2011-088056 A)

SUMMARY OF THE INVENTION

Problem to be Solved by the Invention

The coating material supply method described in Patent Document 1 is effective with little loss of the coating material. However, from a structural problem of the coating-material supply path, only one color coating material can be charged into one cartridge.

Even in the coating material supply method, two layers can be formed from different coating materials in one coating process, that is, two-layer coating with two colors is performable. However, a replacement operation of the coating material cartridge should be performed twice. This increases working hours.

An object of the present invention is to provide an electrostatic coating device and an electrostatic coating method each of which achieves a reduction in working hours and efficient coating at the time when a plurality of layers is coated with a plurality of colors, including two-layer coating with two colors.

Means for Solving the Problem

An electrostatic coating device of the present invention is characterized in that a coating material cartridge includes a plurality of coating-material containers, a that makes a change of colors of coating materials, a common path through which a plurality of coating materials is able to pass according to the change, and a cleaning circuit that cleans up the common path; and the coating material cartridge is configured to be removable from a coating machine.

It is preferable that volumes of the plurality of coating-material containers be changeable according to respective amounts of the coating materials to be charged therein.

It is preferable that the coating material cartridge further include a plurality of individual paths each connected to each of the coating-material containers so that each one of the coating materials passes therethrough, and a plurality of the valves each connected to the common path and each of the individual paths. It is preferable that each of the valves open and close a conduit line between the common path and the each of the coating-material containers connected thereto.

It is preferable that the coating material cartridge include a check valve that connects the cleaning circuit to the common path and prevents inflow of fluid from the common path to the cleaning circuit. It is preferable that the coating material cartridge further include t the coating-material containers, which are coating material bags, a capsule containing the coating material bag, and a pressing fluid path connected to inner spaces inside the capsule and outside the coating material bags.

It is preferable that the coating material cartridge include a plurality of pressing fluid paths connected to one of the inner spaces. It is preferable that the capsule contains the plurality of coating material bags, and a partition member placed between the coating material bags adjacent to each other. It is preferable that the coating material bags partitioned by the partition member have different maximum volumes.

It is preferable that the partition member divide a space in the capsule into a plurality of regions having different volumes. It is preferable that the partition member partially partition the space in the capsule, and a pressing fluid be movable between the plurality of regions.

It is preferable that the electrostatic coating device further include a charging device removable from the coating material cartridge. It is preferable that the charging device include a main path connectable to the common path, the main path be connected to a color change valve, the color change valve be connected to a plurality of 3 flow meters, and the plurality of flow meters be connected to respective tanks having different coating materials.

It is preferable that the electrostatic coating device further include a charging device removable from the coating material cartridge. It is preferable that the charging device include a pressing fluid flow path connected to the pressing fluid path for discharge, and the pressing fluid flow path include a flow meter or be connected to a flow meter.

In an electrostatic coating method of the present invention, a plurality of coating materials is respectively retained in a plurality of coating-material containers in a coating material cartridge. Further, the coating materials are changed by a valve at the time of sending of each of the coating materials.

Further, in an electrostatic coating device, each of the coating materials is sent from the coating material cartridge to a coating machine via a common path according to the change. In the electrostatic coating method of the present invention, multilayer coating is performed by the electrostatic coating device including the coating material cartridge.

It is preferable that the multilayer coating be performed such that after one of the plurality of coating materials thus retained is applied, another one thereof is applied. It is preferable to use coating materials of two or more colors, as the plurality of coating materials.

It is preferable that coating materials having different colors or compositions be charged into two or more coating-material containers at different amounts.

It is preferable to use, in the coating material cartridge, a plurality of coating material bags corresponding to the coating-material containers and having different maximum volumes, a capsule containing the coating material bags and a partition member provided therebetween, a pressing fluid, and a pressing fluid path connected to an inner space inside the capsule and outside the coating material bag.

It is preferable that a space in the capsule be divided by the partition member into a plurality of spaces having different volumes so as to determine a charging amount of each of the coating materials with respect to each of the coating material bags in advance. It is preferable that, when the inner space is filled with the pressing fluid and the pressing fluid presses each of the coating material bags, each of the coating materials be sent from the coating material cartridge to a coating machine.

It is preferable to use, in a charging device connected to the coating material cartridge, a main path connected to the common path and a color change valve. It is preferable that each of the coating materials be sent to the common path via the color change valve and the main path; and by measuring a flow rate of each of the coating materials of different colors to flow into the color change valve, a charging amount of the each of the coating materials with respect to each of the coating material bags be controlled to a value determined in advance.

It is preferable to use, in the coating material cartridge, the coating-material containers as coating material bags, a capsule containing the coating material bags, and a pressing fluid path for discharge connected to an inner space inside the capsule and outside the coating material bags.

Further, it is preferable to use, in a charging device connected to the coating material cartridge, a pressing fluid flow path connected to the pressing fluid path for discharge. It is preferable that: the inner space be filled with the pressing fluid and a flow rate, in the pressing fluid flow path, of the pressing fluid discharged outside in a course of charging each of the coating materials into each of the coating material bags be measured, so as to control a charging amount of the each of the coating materials with respect to the each of the coating material bags to a value determined in advance; and when the pressing fluid presses each of the coating material bags, each of the coating materials be sent outside the coating material cartridge.

Advantageous Effects of Invention

According to the present invention, it is possible to provide an electrostatic coating device and an electrostatic coating method each of which achieves a reduction in working hours and efficient coating at the time when a plurality of layers are coated with a plurality of colors.

MODES FOR CARRYING OUT THE INVENTION

1. First Embodiment

[Electrostatic Coating Device]

An electrostatic coating device according to the present embodiment is a device including a coating material cartridge (FIGS. 1 and 2), a coating machine (FIGS. 7 and 8), and a robot (FIG. 9) including the coating machine. The electrostatic coating device according to the present embodiment is a composite coating system further including a charging device (FIGS. 3 to 6). Hereinafter, the electrostatic coating device may be referred to as an electrostatic coating system from the viewpoint that the electrostatic coating device includes the charging device.

The electrostatic coating device of the present embodiment performs electrostatic coating on an object with a coating material temporarily stored in the coating material cartridge. The coating material cartridge insulates the coating material from a high-voltage generator of the coating machine to be insulated. In view of this, the electrostatic coating device of the present embodiment is suitable for coating of a water-based coating material.

[Summary of Coating Material Cartridge]

Figure 1:
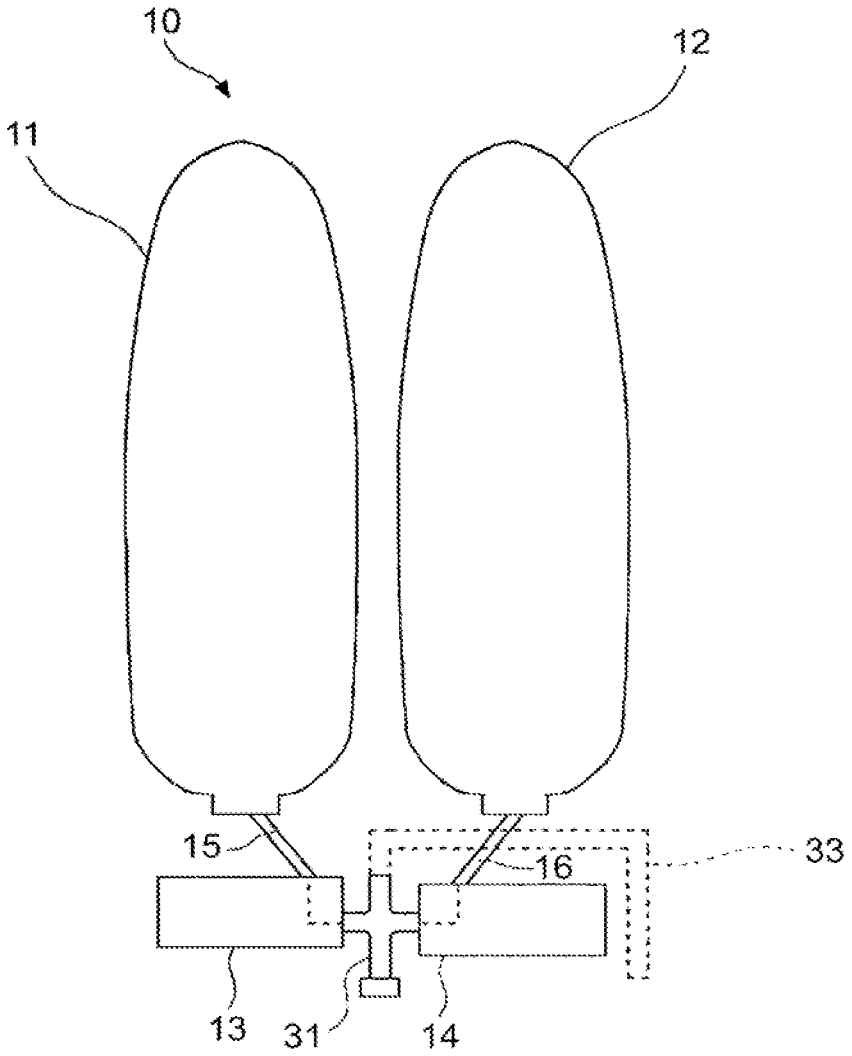
FIG. 1 is a schematic diagram of a coating material cartridge according to a first embodiment.

As illustrated in FIG. 1, a coating material cartridge 10 provided in the electrostatic coating device of the present embodiment includes a plurality of coating-material containers. The coating material cartridge 10 includes a first coating material bag 11 and a second coating material bag 12 as the coating-material containers. The coating material cartridge 10 further includes a first valve 13, a second valve 14, a common path 31, and a cleaning circuit 33.

The first valve 13 and the second valve 14 change coating materials or colors. The common path 31 is configured such that a plurality of coating materials can pass therethrough according to the change of coating materials or colors. The cleaning circuit 33 cleans up the common path 31. Note that volumes of the plurality of coating-material containers can be changed according to amounts of respective coating materials to be charged therein.

[Summary of Electrostatic Coating Method]

In an electrostatic coating method of the present embodiment, multilayer coating is performed by the electrostatic coating device including the coating material cartridge 10. The following steps are performed in the coating material cartridge 10. In the present embodiment, a plurality of coating materials is respectively retained in the plurality of coating-material containers at the same time.

First, the coating materials are changed by valves at the time of sending and charging of each of the coating materials. The valves are the first valve 13 and the second valve 14, for example. Subsequently, the coating materials are respectively charged into the first coating material bag 11 and the second coating material bag 12 via the common path 31 according to the change.

Then, each of the coating materials is sent outside the coating material cartridge 10 via the common path 31 according to the change. Subsequently, the common path 31 is cleaned up by the cleaning circuit 33 every time the coating material is changed.

It is preferable to use coating materials of two or more colors, as the plurality of coating materials. In this case, coating materials of different colors or different compositions are charged into respective coating-material containers by the change of the coating materials in a predetermined order. After that, it is preferable to send the coating materials of different colors or different compositions from the respective coating-material containers by the change of the coating materials in a predetermined order.

In the present embodiment, after one of the plurality of coating materials retained in the coating material cartridge 10 at the same time is applied, the other one of the plurality of coating materials retained at the same time is applied. Hereby, multilayer coating is realized. By use of the electrostatic coating device and the electrostatic coating method of the present embodiment, it is possible to perform two-layer coating with two colors without replacing the coating material cartridge in the middle of a coating operation.

[Details of Coating Material Cartridge]

Figure 2:
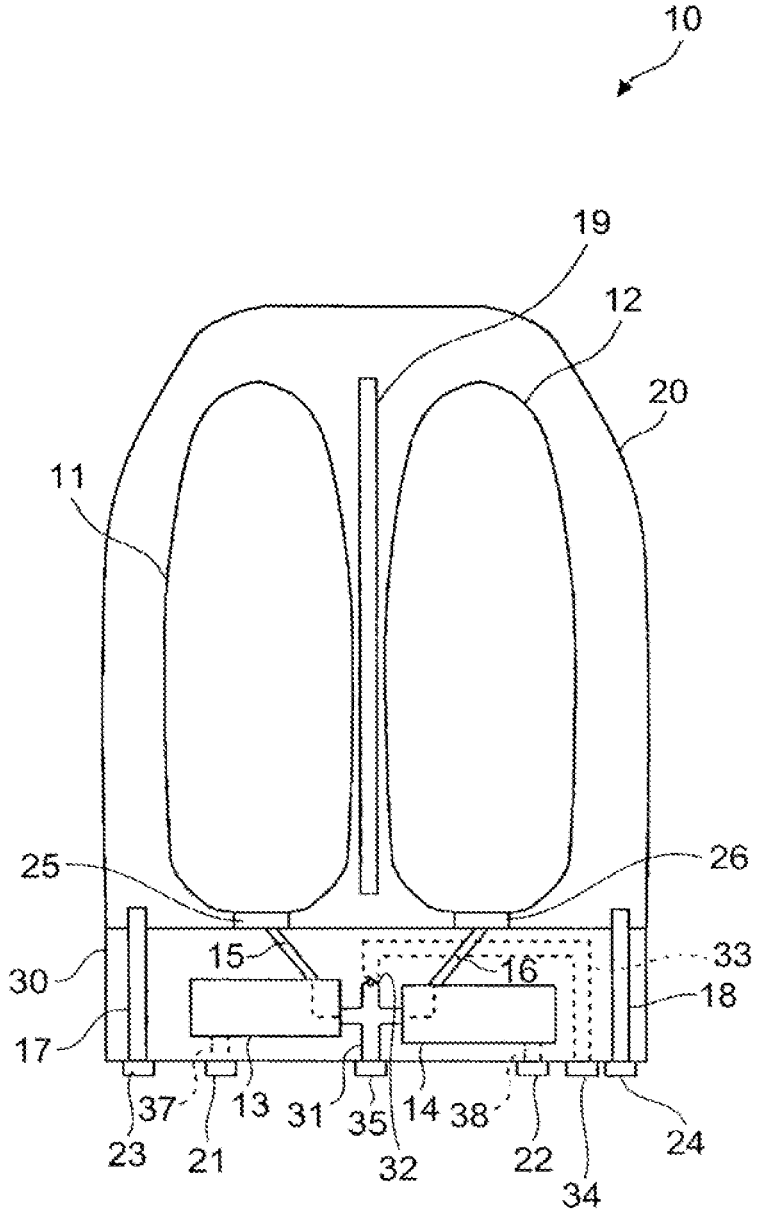
FIG. 2 is a configuration diagram of the coating material cartridge according to the first embodiment.

As illustrated in FIG. 2, the coating material cartridge 10 includes a capsule 20 and a controlling portion 30. The capsule 20 is a cartridge tank including the first coating material bag 11, the second coating material bag 12, a partition member 19, and the like. The controlling portion 30 includes the first valve 13, the second valve 14, the common path 31, and the cleaning circuit 33.

Figure 3:
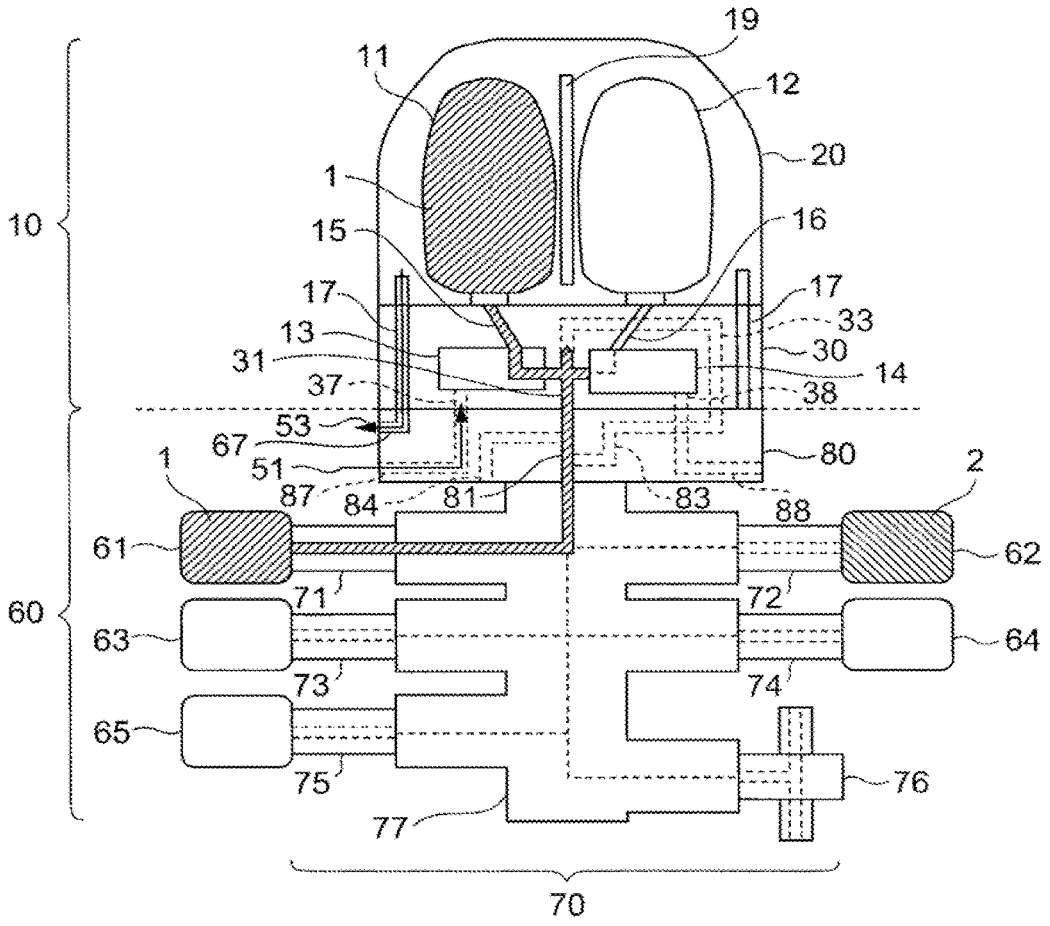
FIG. 3 is an operation diagram of the coating material cartridge and a charging device according to the first embodiment.
Figure 5:
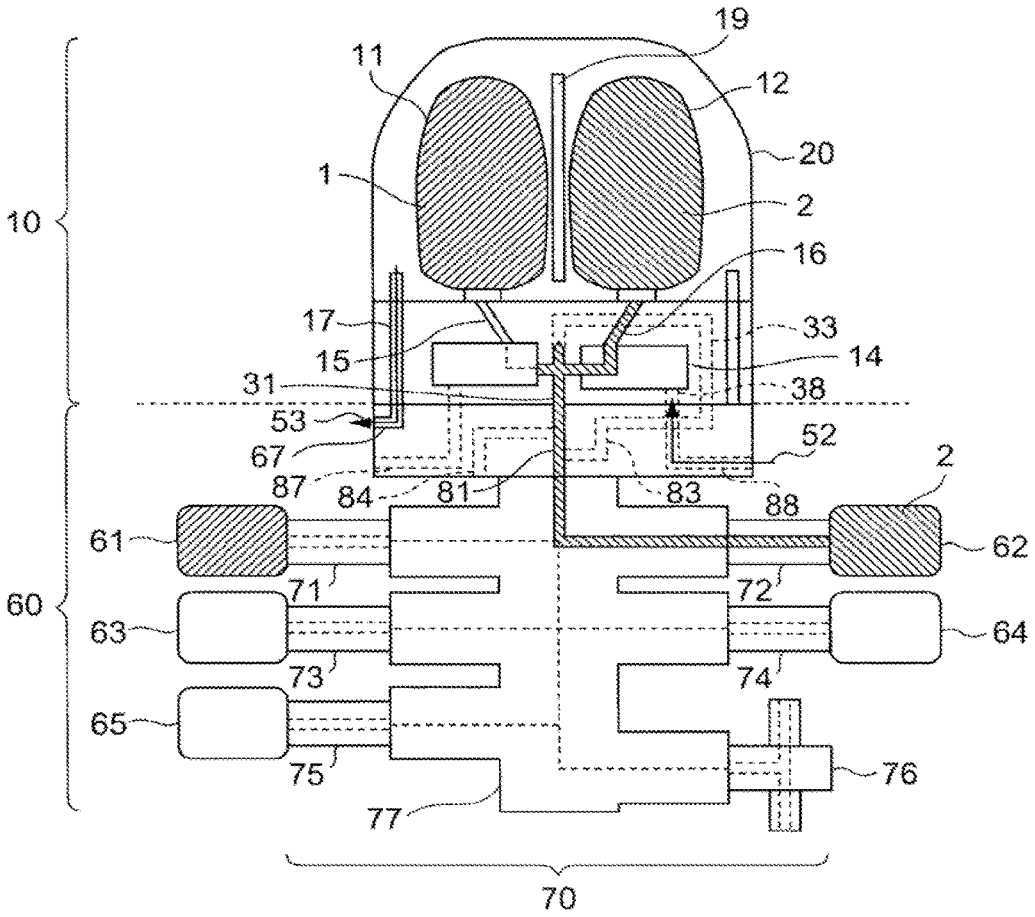
FIG. 5 is an operation diagram of the coating material cartridge and the charging device according to the first embodiment.

The controlling portion 30 further includes a plurality of individual paths, i.e., a first path 15 and a second path 16. As illustrated in FIGS. 3 and 5, which will be described later, each of the individual paths is connected to each of the coating material bags, and each of the coating materials passes through the each of the individual paths. The individual paths can collect respective coating materials in respective coating material bags provided in separate positions, into the common path through the valves. Further, the individual paths can distribute the respective coating materials in the common path into the respective coating material bags.

That is, the first path 15 is connected to the first coating material bag 11 via a connecting portion 25. The connecting portion 25 increases certainty of connection between the first path 15 and the first coating material bag 11. Further, the first path 15 is connected to the first valve 13. The first path 15 sends a first coating material received from the first coating material bag 11 to the first valve 13. Further, the first path 15 sends the first coating material received from the first valve 13 to the first coating material bag 11.

The second path 16 is connected to the second coating material bag 12 via a connecting portion 26. The connecting portion 26 increases certainty of connection between the second path 16 and the second coating material bag 12. Further, the second path 16 is connected to the second valve 14, and sends a second coating material received from the second valve 14 to the second coating material bag 12. Further, the second path 16 sends the second coating material received from the second coating material bag 12 to the second valve 14. Further, the second path 16 sends the second coating material received from the second valve 14 to the second coating material bag 12.

Each of the valves is connected to each of the individual paths and the common path. That is, as illustrated in FIG. 3, which will be described later, the first valve 13 is connected to the first path 15 and the common path 31, and sends the first coating material received from the common path 31 to the first path 15. Further, the first valve 13 sends the first coating material received from the first path 15 to the common path 31.

Further, as illustrated in FIG. 5, which will be described later, the second valve 14 is connected to the second path 16 and the common path 31, and sends the second coating material received from the common path 31 to the second path 16. Further, the second valve 14 sends the second coating material received from the second path 16 to the common path 31.

The common path 31 is provided close to each of the valves in FIG. 5. However, they may not be provided close to each other. For example, the coating material cartridge 10 may further include one or more intermediate paths that connect the common path 31 to each of the valves.

The controlling portion 30 includes a first pilot air path 37 and a second pilot air path 38. Connecting portions 21 and 22 are placed on respective ends, on a cartridge surface, of the first pilot air path 37 and the second pilot air path 38. Each of the pilot air paths is connectable, via each of the connecting portions, to a charging air path of a charging device or a coating air path of a coating machine. Each of the connecting portions increases certainty of connection between each pilot air circuit and an air path of the charging device or the coating machine.

The pilot air paths press respective valves. Each of the valves opens and closes a conduit line between each of the coating-material containers and the common path in response to the pressing. That is, the first valve 13 opens a conduit line between its corresponding first coating material bag 11 and the common path 31 according to an air pressing input (air ON) by the first pilot air path 37. Further, the first valve 13 closes the conduit line between its corresponding first coating material bag 11 and the common path 31 according to an air pressing cancellation input (air OFF) by the first pilot air path 37.

The second valve 14 opens a conduit line between its corresponding second coating material bag 12 and the common path 31 according to an air press input (air ON) by the second pilot air path 38. Further, the second valve 14 closes the conduit line between its corresponding second coating material bag 12 and the common path 31 according to an air press cancellation input (air OFF) by the second pilot air path 38.

As each of the valves, a piston valve, a needle valve, a ball valve, or the like can be used. From the viewpoint that minute adjustment of a flow rate of a coating material can be performed, it is preferable to use a needle valve.

The coating material cartridge includes each valve and the each valve is switched between ON and OFF appropriately, and hereby, a change of a coating-material container to be filled with a predetermined coating material can be performed. Further, by switching ON and OFF of each valve appropriately, it is possible to perform a change of a coating-material container which includes a predetermined coating material and which should send it. As a whole, it is possible to change a coating material or a color to use, by using the valves.

As illustrated in FIG. 2, the common path 31 is connected to each valve, and further connected to the cleaning circuit 33 via a check valve 32. The common path 31 is connectable, via a connecting portion 35, to a main path of the charging device or a sending path of the coating machine, which will be described later.

Figure 4:
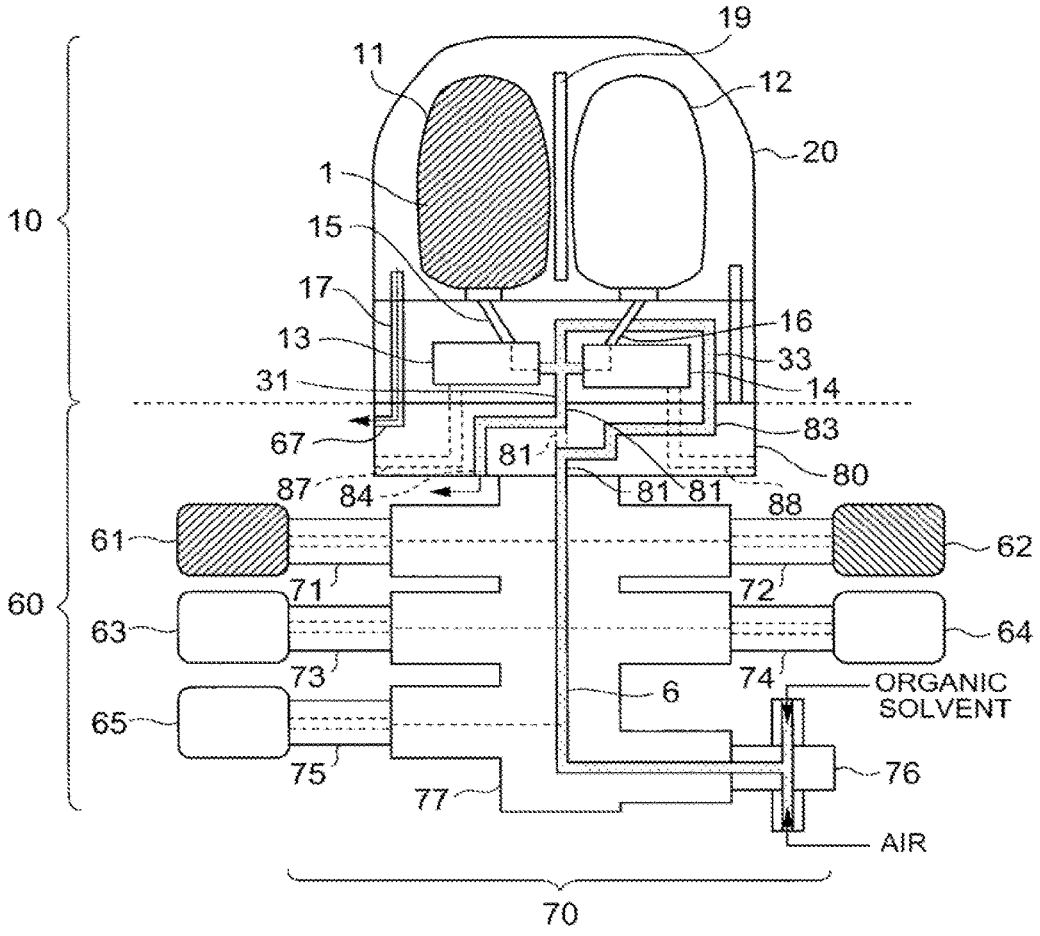
FIG. 4 is an operation diagram of the coating material cartridge and the charging device according to the first embodiment.

As illustrated in FIGS. 3 and 5, which will be described later, when the coating material cartridge 10 is connected to the charging device, the common path 31 sends each coating material received from the main path of the charging device to each valve. Further, as illustrated in FIG. 4, which will be described later, the common path 31 sends a cleaning agent received from the cleaning circuit 33 to the main path of the charging device.

When the coating material cartridge 10 is connected to the coating machine, the common path 31 sends each coating material received from each valve to the sending path of the coating machine. The connecting portion 35 is placed in an end, on the cartridge surface, of the common path 31. The connecting portion 35 increases certainty of connection between the common path 31 and the main path of the charging device or the sending path of the coating machine.

In the present embodiment, by providing the common path 31 in the coating material cartridge 10, one conduit line is collectively used to perform charging and sending of a coating material. This makes it possible to form the coating material cartridge 10 in a compact manner.

The cleaning circuit 33 is connected to the common path 31 via the check valve 32. The cleaning circuit 33 is connectable to the after-mentioned alternative path of the charging device via a connecting portion 34. As illustrated in FIG. 4, which will be described later, when the coating material cartridge 10 is connected to the charging device, the cleaning circuit 33 sends the cleaning agent received from the alternative path of the charging device to the common path 31. The connecting portion 34 is placed in an end, on the cartridge surface, of the cleaning circuit 33. The connecting portion 34 increases certainty of connection between the cleaning circuit 33 and the alternative path of the charging device.

In the present embodiment, the cleaning circuit 33 for cleaning up the common path 31 is provided in the coating material cartridge 10. By cleaning up the common path 31 by the cleaning circuit 33, it is possible to prevent one coating material remaining in the common path 31 from mixing with the other coating material.

The coating material cartridge 10 includes the check valve 32 for connecting the cleaning circuit 33 to the common path 31 and preventing inflow of fluid from the common path to the cleaning circuit. By providing the check valve, it is possible to prevent a coating material from flowing into the cleaning circuit. Unlike a valve freely opening and closing, the check valve does not require a controlling conduit line such as a pilot air path, thereby making it possible to simplify the structure of the coating material cartridge.

The check valve may be a ball check valve, a lift check valve, a swing check valve, a butterfly check valve, or the like. It is preferable to use a ball check valve from the viewpoint that reverse flow of even a very small amount of a coating material can 3 be prevented.

The capsule 20 is a transparent resin molded product, for example. As illustrated in FIG. 2, it is preferable that the capsule 20 have a cylindrical portion or an elliptical tubular portion. An opening of the cylindrical portion or the elliptical tubular portion makes contacts with the controlling portion 30. The capsule 20 can be easily manufactured and cleaned up.

The capsule 20 contains one or more coating material bags. A pressing fluid flows through an inner space inside the capsule 20 and outside the coating material bags. The pressing fluid is a liquid called push-out liquid. The pressing fluid presses the coating material bag so that the coating material is discharged from the coating material bag.

In the meantime, when the coating material is injected into the coating material bag, the coating material bag presses the pressing fluid, so that the capsule 20 discharges the pressing fluid out of the capsule 20. In view of this, it is preferable that the inner space is filled with the pressing fluid.

From the viewpoint of stably keeping a liquid state of the coating material for a long time, the pressing fluid is preferably a nonaqueous liquid. The nonaqueous liquid is preferably toluene, methyl alcohol, acetone, ethyl acetate, and the like, and particularly preferably solvent ED (made by TOYOTA KAGAKU KOGYO Co., Ltd.).

In a case where the capsule 20 includes a plurality of coating material bags, it is preferable that the capsule 20 include a partition member 19. The partition member 19 is placed between coating material bags adjacent to each other. In a case where the capsule 20 includes three, or four or more coating material bags, the partition member may not be provided between some of the coating material bags. Otherwise, the partition member may be provided between every set of coating material bags adjacent to each other.

That is, as illustrated in FIG. 2, the partition member 19 does not completely separate or partition the inner space into two or more spaces. The partition member 19 determines positions of respective coating material bags, thereby preventing that one 3 coating material bag from making contact with the other coating material bag.

The partition member 19 can be a slit-shaped, lattice-shaped, mesh-shaped, or plate-like member, for example. Further, a charging pressure to the coating material bag often reaches 0.4 to 0.8 MPa. Accordingly, in consideration of a pressure receiving area, it is assumed that the partition member 19 receives a pressure of 8 kgf/cm$^2$ from the coating material bag, and thus, the partition member 19 receives a force of 1500 kgf. In view of this, a material of the partition member 19, for example, is preferably a high-strength resin or engineer plastic, from the viewpoint of strength.

In order to smoothly put the coating material and the pressing fluid in and out of the capsule, the coating material bag is preferably a bag having elasticity. In the meantime, it is necessary for the coating material bag to be a bag that prevents invasion of the coating material.

The controlling portion 30 includes a pressing fluid path 17 for discharge of the pressing fluid and a pressing fluid path 18 for injection thereof. One end of each of the pressing fluid paths is connected to the inner space. The other end of each of the pressing fluid paths is connected to an outside of the capsule 20 or an outer space outside the capsule 20. As illustrated in FIG. 2, when the coating material cartridge 10 is not connected to other devices, the pressing fluid paths 17, 18 are connected to the outer space outside the capsule 20.

As illustrated in FIGS. 3 to 5, when the coating material cartridge 10 is connected to a charging device 60, the pressing fluid path 17 is connected to a pressing fluid flow path 67 of the charging device 60. At this time, the pressing fluid path 17 is connected to the outer space outside the capsule 20 via the pressing fluid flow path 67.

Figure 7:
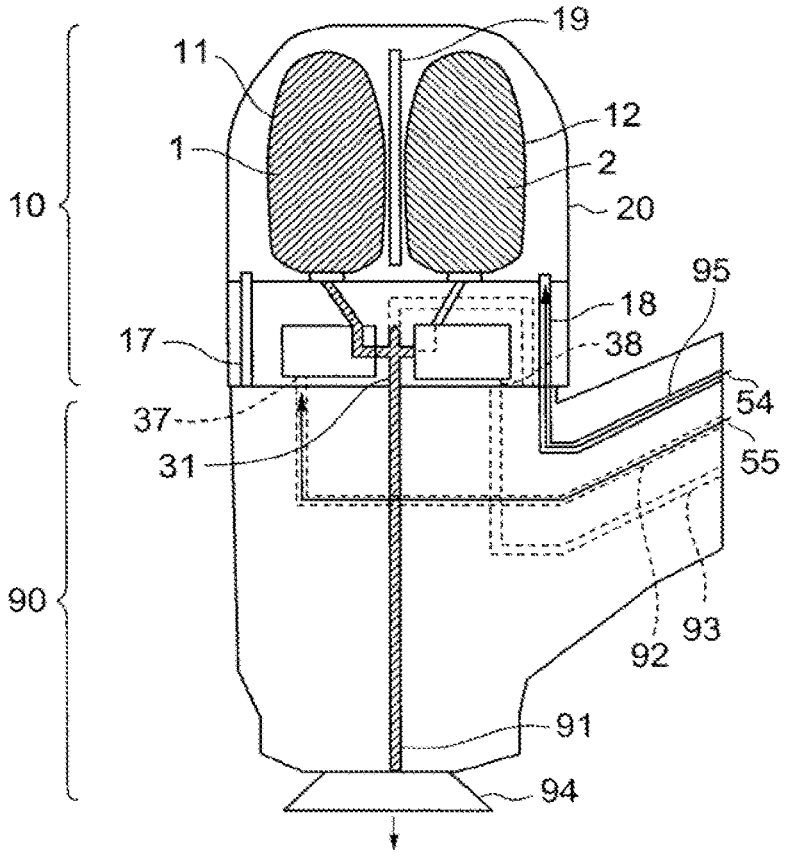
FIG. 7 is an operation diagram of the coating material cartridge and a coating machine according to the first embodiment.

As illustrated in FIG. 7, when the coating material cartridge 10 is connected to a coating machine 90, the pressing fluid path 18 is connected to a pressing fluid flow path 95 of the coating machine 90. At this time, the pressing fluid path 18 is connected to a space outside the capsule 20 via the pressing fluid flow path 95.

Note that the pressing fluid path 17 for discharge and the pressing fluid path 18 for injection may be a single pressing fluid path having both functions thereof.

The pressing fluid path 17 is connectable to the pressing fluid flow path of the charging device. When the coating material cartridge 10 is connected to the charging device, the pressing fluid path 17 sends the pressing fluid received from the capsule 20 to the pressing fluid flow path of the charging device.

The pressing fluid path 18 is connectable to the pressing fluid flow path of the coating machine. When the coating material cartridge 10 is connected to the coating machine, the pressing fluid path 18 sends the pressing fluid received from the pressing fluid flow path to the capsule 20.

Connecting portions 23 and 24 are placed on respective ends, on the cartridge surface, of the pressing fluid paths 17 and 18. The connecting portion 23 increases certainty of connection between the pressing fluid path 17 and the pressing fluid flow path of the charging device. The connecting portion 24 increases certainty of connection between the pressing fluid path 18 and the pressing fluid flow path of the coating machine.

The pressing fluid path 17 discharges the pressing fluid inside the capsule 20 according to that volume of the coating material bag which increases due to charging of the coating material. The pressing fluid path 18 injects the pressing fluid into the capsule so as to send the coating material out of the coating material bag. The pressing fluid presses the coating material bag. Accordingly, the pressing fluid sends out each of the coating material outside the coating material cartridge 10. As a whole, the pressing fluid and the pressing fluid path control charging/sending of the coating material in the coating material cartridge 10.

[Charging Device]

FIG. 3 illustrates a state where the coating material cartridge 10 is connected to the charging device 60 and the electrostatic coating device charges the first coating material bag 11 into the first coating material 1. The charging device 60 is connectable to and removable from the coating material cartridge 10. The charging device 60 includes a color change valve 70 and a pipe portion 80.

The pipe portion 80 includes a main path 81, an alternative path 83, a 3 discharge path 84, a plurality of charging air paths, and the pressing fluid flow path 67. In the present embodiment, the pipe portion 80 includes a first charging air path 87 and a second charging air path 88 as the plurality of charging air paths. The color change valve 70 includes connecting portions 71 to 75, a junction portion 76, and a valve portion 77.

The main path 81 is connected to the color change valve 70, and is further connectable to the common path 31. When the charging device 60 is connected to the coating material cartridge 10, the main path 81 sends each coating material received from the color change valve 70 to the common path 31.

The main path 81 is further connectable to the alternative path 83. The main path 81 sends, to the alternative path 83, a cleaning agent received from the color change valve 70. The main path 81 is further connectable to the discharge path 84. When the charging device 60 is connected to the coating material cartridge 10, the main path 81 sends the cleaning agent received from the common path 31 to the discharge path 84.

Note that, on the main path 81, valves may be provided in a connection part with the alternative path 83, a connection part with the discharge path 84, and between these connection parts. When the coating material passes through the main path 81, the valves provided in the connection part with the alternative path 83 and in the connection part with the discharge path 84 are closed, and when the cleaning agent passes therethrough, the valves are opened.

When the coating material passes through the main path 81, the valve provided between the connection part with the alternative path 83 and the connection part with the discharge path 84 is opened. When the cleaning agent passes through the main path 81, the valve is closed.

The main path 81 sends a plurality of coating materials to the common path 31 and receives a waste cleaning agent from the common path 31. The main path 81 supplements a function of the common path 31 to distribute the plurality of coating materials to respective coating material bags.

The alternative path 83 is connected to the main path 81, and further 3 connectable to the cleaning circuit 33. When the charging device 60 is connected to the coating material cartridge 10, the alternative path 83 sends the cleaning agent received from the main path 81 to the cleaning circuit 33.

The alternative path 83 sends out the cleaning agent to the cleaning circuit 33. The alternative path 83 supplements a function of the cleaning circuit 33 to clean up the common path 31. Further, when the alternative path 83 is connected to the main path 81, the cleaning agent can wash away a coating material remaining in a color-change-valve-70 side of the main path 81 and the color change valve 70.

The discharge path 84 branches off from the main path 81, and is connectable to a damp path (not shown). The discharge path 84 sends the cleaning agent received from the main path 81 to the damp path. That is, the discharge path 84 discharges fluid passing through the cleaning circuit 33.

The discharge path 84 receives a waste cleaning agent from the main path 81. The discharge path 84 supplements a function of the main path 81 to assist cleaning of the common path 31. Further, when the discharge path 84 is connected to the main path 81, the cleaning agent can wash away a coating material remaining on that mounting surface side of the main path 81 on which the coating material cartridge 10 is mounted.

Each of the charging air paths is connectable to each of the pilot air paths in a one-to-one manner. The first charging air path 87 is connected to an air charging system (not shown), and is further connectable to the first pilot air path 37. When the charging device 60 is connected to the coating material cartridge 10, the first charging air path 87 transmits, to the first pilot air path 37, an input of air ON or OFF received from the air charging system.

The second charging air path 88 is connected to an air charging system (not shown), and is further connectable to the second pilot air path 38. When the charging device 60 is connected to the coating material cartridge 10, the second charging air path 88 transmits, to the second pilot air path 38, an input of air ON or OFF received from the air charging system. The charging air path assists the change of a coating-material container to be filled with a predetermined coating material, which change is performed by each valve of the coating material cartridge 10.

The pressing fluid flow path 67 is connected to a pressing fluid tank (not shown), and is connectable to the pressing fluid path 17. When the charging device 60 is connected to the coating material cartridge 10, the pressing fluid flow path 67 sends, to the pressing fluid tank, the pressing fluid received from the pressing fluid path 17. The pressing fluid flow path 67 assists that discharge of the pressing fluid from the capsule 20 which is performed by the pressing fluid path 17.

The connecting portions 71 to 75 are connected to a first tank 61, a second tank 62, and the other tanks 63 to 65, respectively. The connecting portions 71 to 75 are further connected to the valve portion 77. The connecting portion 71 sends, to the valve portion 77, the first coating material 1 received from the first tank 61. The connecting portion 72 sends, to the valve portion 77, the second coating material 2 received from the second tank 62. The connecting portions 73 to 75 send, to the valve portion 77, the other coating materials received from the other tanks 63 to 65, respectively.

The junction portion 76 is connected to an organic solvent tank and an air tank (not shown), and the valve portion 77. As illustrated in FIG. 4, which will be described later, the junction portion 76 sends, to the valve portion 77, an organic solvent received from the organic solvent tank as the cleaning agent. Further, the junction portion 76 sends the air received from the air tank to the valve portion 77. From the viewpoint of detergency, thinner is preferable as the organic solvent.

[Coating Material Charging Operation]

Referring now to FIGS. 3 to 6, a coating material charging operation is described. As illustrated in FIG. 4, when the charging device 60 is connected to the coating material cartridge 10, the charging device 60 starts a step of cleaning up the common path 31 by supplying the cleaning agent via the cleaning circuit 33. Here, the abovementioned organic solvent tank and air tank may supply a pressure to send the cleaning agent.

The junction portion 76 sends the cleaning agent and the air to the valve portion 77. The color change valve 70 sends the cleaning agent to the main path 81 and the alternative path 83 of the pipe portion 80 via the valve portion 77. The pipe portion 80 sends the cleaning agent received from the color change valve 70 to the cleaning circuit 33 of the coating material cartridge 10. The cleaning circuit 33 sends the cleaning agent received from the charging device 60 to the common path 31.

The cleaning agent opens the check valve 32 and moves from the cleaning circuit 33 to the common path 31. The cleaning agent washes away a residual coating to material from the common path 31. Since each of the valves of the coating material cartridge 10 is closed, the cleaning agent does not come inside each of the individual paths.

After the common path 31 receives the cleaning agent from the cleaning circuit 33, the common path 31 returns the waste cleaning agent to the main path 81 of the charging device 60. The check valve 32 prevents the waste cleaning agent from flowing backward toward the cleaning circuit 33.

The main path 81 sends, to the discharge path 84, the cleaning agent received from the common path 31. Finally, the pipe portion 80 discharges the waste cleaning agent received from the coating material cartridge 10 to the damp path (not shown) via the main path 81 and the discharge path 84.

Subsequently, as illustrated in FIG. 3, the charging device 60 selectively sends the first coating material 1 to the coating material cartridge via the color change valve 70. In the electrostatic coating system, one valve in the coating material cartridge opens a conduit line between the common path 31 and one coating-material container. As described above, each of the valves in the coating material cartridge is controlled by the charging air paths of the charging device 60.

Here, the one coating-material container is assumed the first coating material bag 11 into which the first coating material 1 is charged. In this case, the charging device 60 selects the first valve 13 as the one valve. The air charging system transmits a pressure 51 of the pilot air via the first charging air path 87 and the first pilot air path 37, so as to open the first valve 13 (air ON).

The charging device 60 opens the one valve, so as to start a step of charging one coating material into the one coating-material container via the common path 31. The first coating material 1 moves into the first coating material bag 11 via the first tank 61, the 3 color change valve 70, the main path 81, the common path 31, the first valve 13, and the first path 15.

When the injection of the coating material is advanced and the first coating material bag 11 expands, the pressing fluid flows out of the capsule 20 along an outflow direction 53 via the pressing fluid path 17 and the pressing fluid flow path 67. The pressing fluid is filled in the inner space of the capsule 20 in advance.

Since the second valve 14 is closed, the first coating material 1 is prevented from flowing into the second path 16. Further, since the check valve 32 is provided, the first coating material 1 is prevented from flowing into the cleaning circuit 33.

When the injection of the coating material is advanced and the first coating material bag 11 expands, the first coating material bag 11 is eventually pressed against an inner wall of the capsule 20 and a wall surface of the partition member 19. At this time, the first coating material bag 11 has just finished storing therein a predetermined amount of the first coating material 1 and stops expanding. The charging device 60 finishes charging of the first coating material 1.

The partition member 19 blocks a force of the first coating material bag 1 to crush the second coating material bag 12. Because of this, during and after the charging of the first coating material 1, the second coating material bag 12 is hardly affected by the first coating material bag 11 dynamically.

The charging device 60 may finish the charging of the first coating material 1 based on a timer. After a predetermined time has passed from a start of the charging, the timer may close a conduit line in any part of a charging path of the first coating material 1.

A volume of the coating material to be stored in the coating material bag is limited or prescribed to a maximum volume of the coating material bag. The volume is also limited or prescribed by the inner wall of the capsule 20 or the wall surface of the partition member 19. Even if the volume of the coating material to be charged does not reach the limited volume, the timer can stop the charging of the coating material.

After the charging device 60 finishes injecting the predetermined amount of the first coating material 1, the one valve executes a step of closing the conduit line between the common path and the one coating-material container. The air charging system transmits a cancellation of the pressure of the pilot air via the first charging air path 87 and the first pilot air path 37, so as to close the first valve 13 (air OFF). Hereby, the charging of the first coating material 1 is finished.

Subsequently, as illustrated in FIG. 4, the charging device 60 executes again the step of cleaning the common path 31 by supplying the cleaning agent via the cleaning circuit 33. By this step, the charging device 60 removes the first coating material 1 remaining in the common path 31, thereby preventing the first coating material 1 from mixing into the second coating material 2.

As illustrated in FIG. 5, the charging device 60 executes a step of opening, by the other valve, a conduit line between the common path and the other coating-material container. Here, the other coating-material container is assumed the second coating material bag 12 into which the second coating material 2 is charged.

In this case, the charging device 60 selects the second valve 14 as the other valve. The air charging system transmits a pressure 52 of the pilot air via the second charging air path 88 and the second pilot air path 38, so as to open the second valve 14 (air ON).

The charging device 60 opens the other valve, so as to execute a step of charging the other coating material into the other coating-material container via the common path 31. The second coating material 2 moves into the second coating material bag 12 via the second tank 62, the color change valve 70, the main path 81, the common path 31, the second valve 14, and the second path 16. When the injection of the coating material is advanced and the second coating material bag 12 expands, the pressing fluid flows out of the capsule 20 along the outflow direction 53 via the pressing fluid path 17 and the pressing fluid flow path 67.

Since the first valve 13 is closed, the second coating material 2 is prevented from flowing into the first path 15. Further, since the check valve 32 is provided, the second coating material 2 is prevented from flowing into the cleaning circuit 33.

When the injection of the coating material is advanced and the second coating material bag 12 expands, the second coating material bag 12 is eventually pressed against an inner wall of the capsule 20 and a wall surface of the partition member 19. At this time, the second coating material bag 12 has just finished storing therein a predetermined amount of the second coating material 2 and stops expanding. The charging device 60 finishes charging of the second coating material 2.

The partition member 19 blocks a force of the second coating material bag 12 to crush the first coating material bag 11. Because of this, during and after the charging of the second coating material 2, the first coating material bag 11 is hardly affected by the second coating material bag 12 dynamically.

The charging device 60 may finish the charging of the second coating material 2 based on a timer. After a predetermined time has passed from a start of the charging, the timer may close a conduit line in any part of a charging path of the coating material 2.

After the charging device 60 finishes injecting the predetermined amount of the second coating material 2, the other valve starts a step of closing the conduit line between the common path and the other coating-material container. The air charging system transmits a cancellation of the pressure of the pilot air via the second charging air path 88 and the second pilot air path 38, so as to close the second valve 14 (air OFF).

Note that the coating material charging operation shows an example in which the coating materials are charged into the first coating material bag 11 and the second coating material bag 12 in this order. However, in the present embodiment, the order of the coating-material containers or the coating material bags is not limited in particular. Accordingly, the coating materials may be charged into the second coating material bag 12 and then the first coating material bag 11, sequentially.

[Replacement of Coating Material Cartridge]

Figure 6:
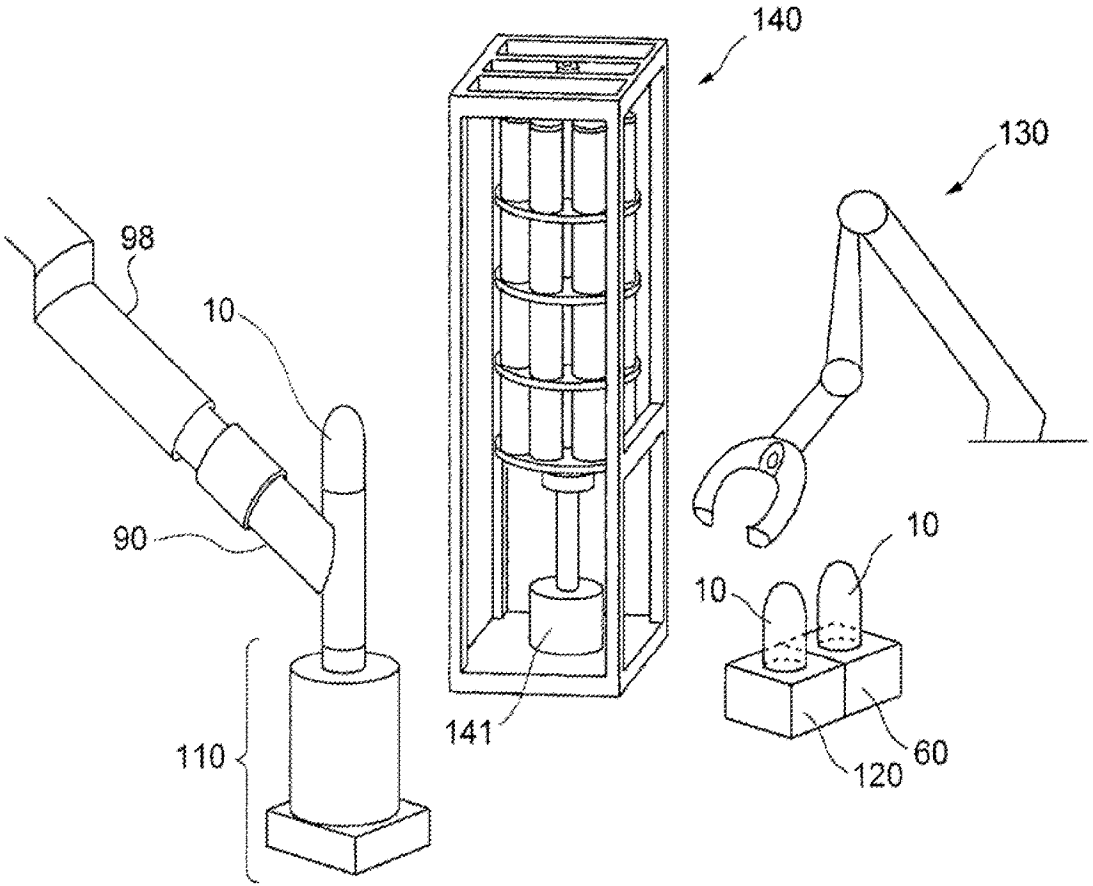
FIG. 6 is a view of the charging device according to the first embodiment.

FIG. 6 illustrates the charging device 60 and pan of a robot 98 in an origin where replacement of the coating material cartridge is performed. The robot 98 uses a cleaning fluid collection hopper 110 as an operation origin.

Initially, the robot 98 including the coating machine 90 reaches the cleaning fluid collection hopper 110. A waste coating material cartridge 10 is detached from the coating machine 90. A cartridge transfer robot 130 places the waste coating material cartridge 10 on a temporary placing stand 120. The temporary placing stand 120 receives the waste coating material cartridge 10 from the cartridge transfer robot 130.

The waste coating material cartridge 10 placed on the temporary placing stand 120 is attached to the charging device 60. The charging device 60 cleans up the waste coating material cartridge 10. The coating material cartridge 10 thus cleaned up to be empty is returned to a stocker 140.

The stocker 140 is a rotary cartridge stocker including a motor 141. The stocker 140 stores therein coating material cartridges 10 that do not include coating materials. An empty coating material cartridge 10 is transferred from the stocker 140 to the charging device 60. The empty coating material cartridge 10 is attached to the charging device 60.

The charging device 60 charges coating materials into the empty coating material cartridge 10. The cartridge transfer robot 130 receives, from the charging device 60, the coating material cartridge 10 filled with the coating materials, and then passes it to the coating machine 90.

The coating machine 90 receives the coating material cartridge 10 filled with the coating materials from the cartridge transfer robot 130. The coating material cartridge 10 filled with the coating materials is attached to the coating machine 90. After that, the robot 98 moves the coating machine 90 from the origin to a coating position.

[Coating Machines]

FIG. 7 illustrates a state where the coating material cartridge 10 is connected to the coating machine 90 and the first coating material 1 is sent from the first coating material bag 11. The coating machine 90 includes a sending path 91, a plurality of coating air paths, a rotary atomizing head 94, and the pressing fluid flow path 95. In the present embodiment, the coating machine 90 includes a rust coating air path 92 and a second coating air path 93 as the plurality of coating air paths.

Figure 8:
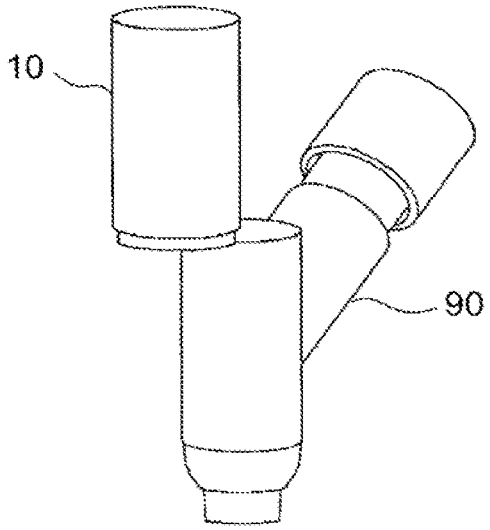
FIG. 8 is an outside drawing of the coating material cartridge and the coating machine according to the first embodiment.
Figure 9:
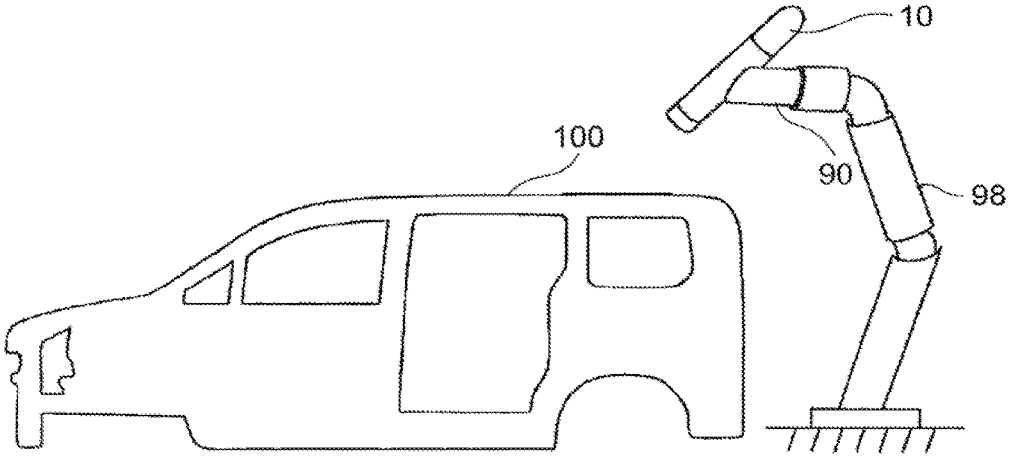
FIG. 9 is an in-use view of the coating machine according to the first embodiment.

FIG. 8 illustrates a state before the attachment, and the coating material cartridge 10 is connectable to and removable from the coating machine 90. The coating machine 90 connected to the coating material cartridge 10 is placed in a tip of the robot 98 as illustrated in FIG. 9. The robot 98 has a joint portion or a rotary portion. Hereby, the robot 98 places the coating machine 90 on a given place around a vehicle body 100.

Further, the robot 98 can change an orientation of a nozzle or a bell cup of the coating machine 90 toward a given direction. The robot 98 can automatically reciprocate the coating machine 90 and the coating material cartridge 10 between the vehicle body 100 to be coated and the charging device (not shown), according to a predetermined program.

The sending path 91 is connected to the rotary atomizing head 94, and is further connectable to the common path 31. When the coating machine 90 is connected to the coating material cartridge 10, the sending path 91 sends each of the coating materials received from the common path 31 to the rotary atomizing head 94. The rotary atomizing head 94 sprays the each of the coating materials to the vehicle body 100, as illustrated in FIG. 9. The each of the coating materials is firmly fixed to the vehicle body 100 by an electrostatic effect.

Each of the coating air paths is connectable to each of the pilot air paths in a one-to-one manner. The first coating air path 92 is connected to an air charging system (not shown), and is further connectable to the first pilot air path 37. When the coating machine 90 is connected to the coating material cartridge 10, the first coating air path 92 transmits, to the first pilot air path 37, an input of air ON or OFF received from the air charging system.

The second coating air path 93 is connected to an air charging system (not shown), and is further connectable to the second pilot air path 38. When the coating machine 90 is connected to the coating material cartridge 10, the second coating air path 93 transmits, to the second pilot air path 38, an input of air ON or OFF received from the air charging system. The coating air path assists the change of a coating-material container including a predetermined coating material and sending it, which change is performed by 3 each of the valves of the coating material cartridge 10.

The pressing fluid flow path 95 is connected to a pressing fluid pump (not shown), and is further connectable to the pressing fluid path 18 (not shown). When the coating machine 90 is connected to the coating material cartridge 10, the pressing fluid flow path 95 sends the pressing fluid received from the pressing fluid pump to the pressing to fluid path 18. The pressing fluid flow path 95 assists that injection of the pressing fluid into the capsule 20 by the pressing fluid path 18.

[Coating Operation]

As illustrated in FIG. 7, the electrostatic coating device executes a step of opening, by one valve, a conduit line between the common path 31 and one coating-material container. Here, the one coating-material container is assumed the first coating material bag 11 into which the first coating material 1 is charged.

In this case, the electrostatic coating device selects the first valve 13 as one valve. The air charging system transmits a pressure 55 of the pilot air via the first coating air path 92 and the first pilot air path 37, so as to open the first valve 13 (air ON).

Subsequently, the electrostatic coating device executes a step of sending one coating material from the one coating-material container and forming one coating layer on a vehicle body of an automobile or the like coating object. The pressing fluid flows into the capsule 20 along an inflow direction 54 via the pressing fluid path 18 and the pressing fluid flow path 95. Along with inflow of the pressing fluid, the first coating material bag contracts under a pressure of the pressing fluid.

Hereby, the first coating material bag 11 extrudes the first coating material 1 into the first path 15. The first coating material 1 moves into the rotary atomizing head 94 through the first coating material bag 11, the first path 15, the first valve 13, the common path 31, and the sending path 91, and then, the first coating material 1 is splayed to the vehicle body 100. When the first coating material 1 is sprayed, the rotary atomizing head 94 gives an electric charge to the first coating material 1. The spray of the first coating material 1 having an electric charge is attached to a vehicle body of an automobile or the like coating object having a reverse electric charge.

Since the second valve 14 is closed, the first coating material 1 is prevented from flowing into the second path 16. Further, since the check valve 32 is provided, the first coating material 1 is prevented from flowing into the cleaning circuit 33.

After the electrostatic coating device finishes sending a predetermined amount of the first coating material 1, the one valve executes a step of closing, by the one valve, the conduit line between the common path and the one coating-material container. The air charging system transmits a cancellation of the pressure of the pilot air via the first coating air path 92 and the first pilot air path 37, so as to close the first valve 13 (air OFF). Hereby, the sending of the first coating material 1 is finished. Further, if the first coating material bag 11 empties, the sending of the first coating material 1 is finished.

The electrostatic coating device executes a step of opening, by the other valve, a conduit line between the common path 31 and the other coating-material container. The electrostatic coating device further executes a step of sending the other coating material from the other coating-material container to perform pre-spray of spraying the other coating material, and then forming the other coating layer on the one coating layer.

The second coating material 2 moves into the rotary atomizing head 94 from the second coating material bag 12 in the same procedure as the first coating material 1. The second coating material 2 sprayed forms a new coating layer on the coating layer formed of the first coating material 1 on the vehicle body 100.

Note that the above coating operation shows an example in which the first coating material 1 and the second coating material 2 are applied in this order, but the order of the coating materials is not limited in particular.

[Description of Problems and Effects]

When two-layer coating with two colors is performed in a manufacturing process of an automobile or the like, the appearance and weather resistance of a coating surface of the automobile or the like is improved. However, in a conventional cartridge system, for example, only one color coating material can be charged into one cartridge in some cases.

Accordingly, it is necessary to perform coating by changing the cartridge per color in the middle of a coating operation. From another viewpoint, a cartridge 3 replacement operation should be performed one extra time in comparison with one-layer coating with one color, thereby resulting in that working hours increase.

Figure 10:
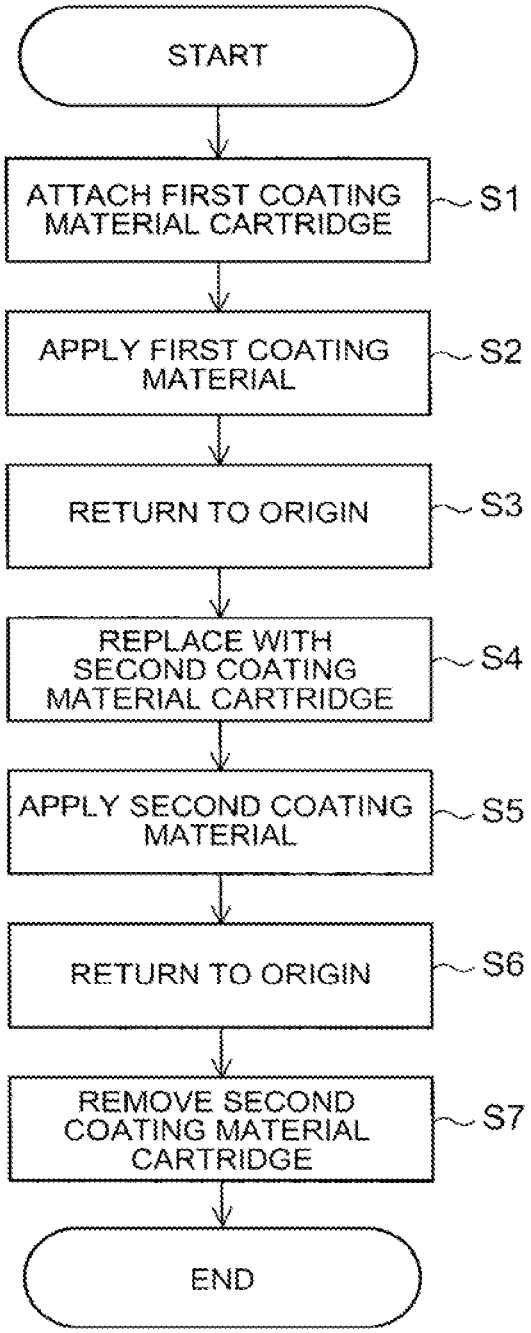
FIG. 10 is an outside drawing of the coating material cartridge and the coating machine according to the first embodiment.

As illustrated in FIG. 10, in a case where two-layer coating with two colors is performed in one process without the use of the electrostatic coating device or the electrostatic coating method of the present embodiment, the following steps are required. First, in a cleaning fluid collection hopper as an origin, a robot attaches a coating material cartridge including a first coating material to a coating machine included in the robot (step S1). Subsequently, the robot performs application (workpiece application) of the first coating material (step S2). Then, the robot returns to the origin (step S3).

The robot removes the coating material cartridge, and attaches a new 1*t* coating material cartridge including a second coating material to the coating machine (step S4). Subsequently, the robot performs application (workpiece application) of the second coating material (step S5). Then, the robot returns to the origin (step S6). The robot then removes the coating material cartridge, and prepares for attaching the coating material cartridge containing the second coating material to the coating machine (step S7). As such, many operations occur, so that it takes time even if the operations are automated.

The inventors has found, as described above, that it is possible to realize a reduction in steps by performing two-layer coating with two colors coat color in a base one process. The electrostatic coating device of the present embodiment is configured such that a cartridge includes a plurality of color coating materials and the coating materials or colors can be changed in the middle of a coating process.

In view of this, according to the electrostatic coating device or the electrostatic coating method of the present embodiment, it is possible to perform two-layer coating with two colors without replacing the coating material cartridge in the middle of the coating operation. By use of the electrostatic coating device or the electrostatic coating method of the present embodiment, it is possible to increase manufacture efficiency while performing two-layer coating with two colors.

Figure 11:
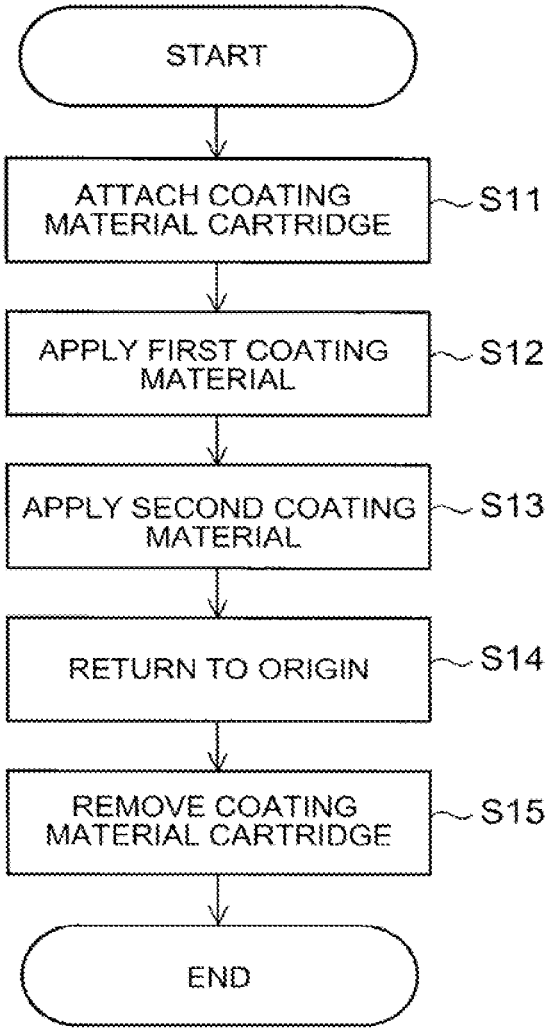
FIG. 11 is an in-use view of the coating machine according to the first embodiment.

As illustrated in FIG. 11, in a case where two-layer coating with two colors is performed in one process with the use of the electrostatic coating device of the present 3 embodiment, the following steps are required. First, in the origin, the robot attaches a coating material cartridge including the first coating material and the second coating material to the coating machine included in the robot (step S11). Subsequently, the robot performs application (workpiece application) of the first coating material (step S12).

Subsequently, the robot performs application (workpiece application) of the second coating material without returning to the origin (step S12). Then, the robot returns to the origin (step S14). Then, the robot removes the coating material cartridge, and prepares for attaching a new coating material cartridge to the coating machine (step S15).

In a case of the operation by the robot, it is not necessary for the robot to return once to a robot original position to replace the cartridge. The robot changes the coating material or the color in a position of a target to be coated. As such, it is possible to perform two-layer coating with two colors by one operation, thereby making it possible to shorten coating time.

2. Second Embodiment

The following mainly deals with differences from the first embodiment. Further, a constituent equivalent to that in the first embodiment has the same reference sign as in the first embodiment, and redundant explanation is omitted.

[Problem to be Solved by the Invention]

A thickness ratio between respective layers may be changed in two-layer coating with two colors. For example, it is assumed that a thickness ratio between a layer to be applied first and a layer to be applied later may be set to 1:1 to 1:4. At this time, when a layer having a large thickness is applied, a coating material in a cartridge may become insufficient. In such a case, it is necessary to recharge the coating material, which decreases entire working efficiency.

The problem also occurs even in a case where an amount of a coating material to be retained in a coating-material container is prescribed by a partition member. When the thickness ratio is uneven, a charging amount of a coating material necessary for a thicker layer is large. Due to the partition member, a maximum amount that can be charged in the coating-material container is not enough for this.

Here, one of the solutions is to upsize the coating material cartridge. In such a case, the coating-material container can be configured to have a sufficient size to charge a necessary volume of the coating material therein. However, such a solution is not preferable, because the device is upsized or increased in weight.

[Coating Material Cartridge]

Figure 12:
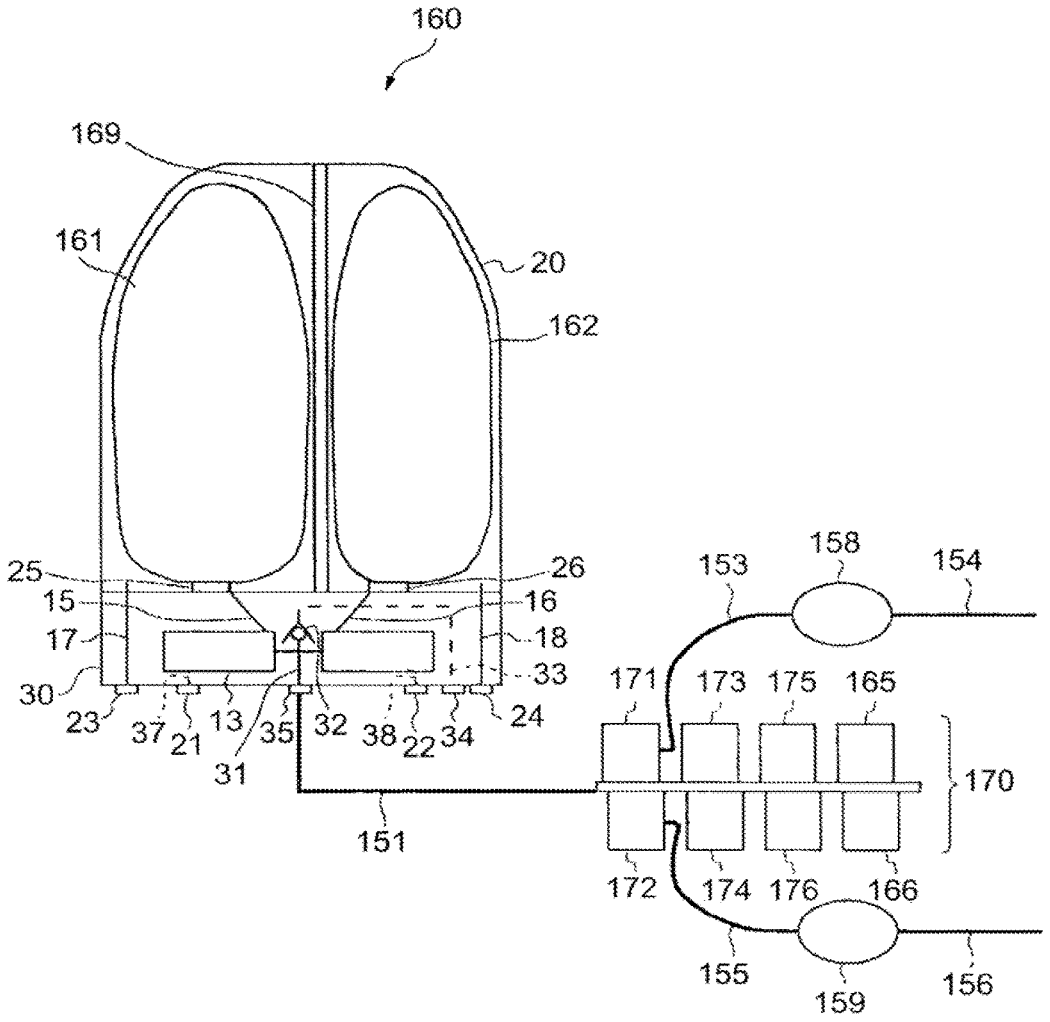
FIG. 12 is a configuration drawing of Aspect 1 according to a second embodiment.
Figure 13:
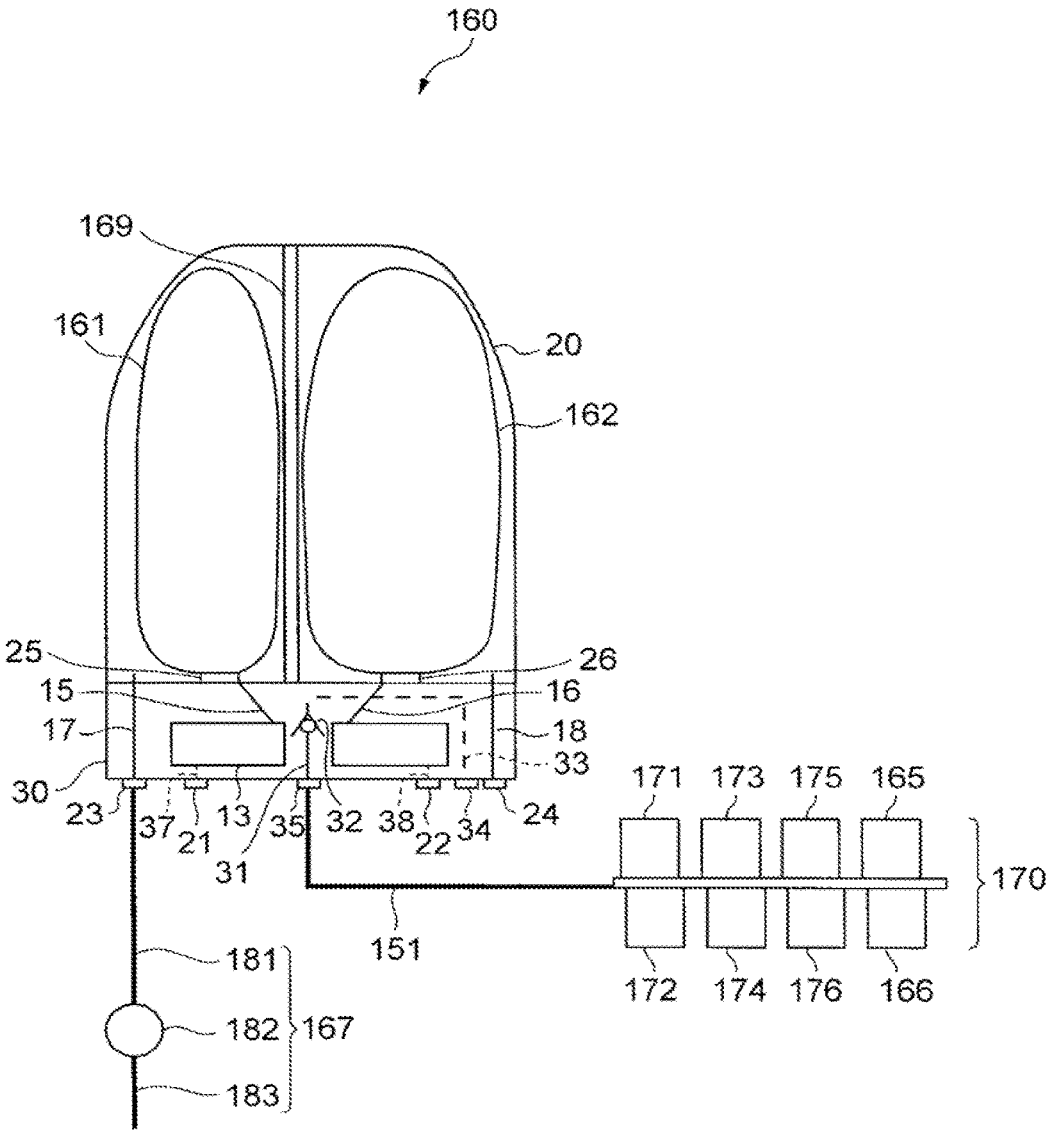
FIG. 13 is a configuration drawing of Aspect 2 according to the second embodiment.

As illustrated in FIGS. 12, 13, in the present embodiment, instead of the coating material cartridge 10 (FIGS. 1, 2), a coating material cartridge 160 is provided.

The coating material cartridge 160 includes a capsule 20, a partition member 169, and a plurality of coating material bags. The partition member 169 is attached in the capsule 20 in an off-center manner. The coating material bags correspond to coating-material containers. It is preferable that the coating material bags have different maximum volumes.

In a case where the capsule 20 includes three, or four or more coating material bags, some of the coating material bags may have the same volume. Further, all the coating material bags may have maximum volumes different from each other.

The capsule 20 contains the plurality of coating material bags and the partition member 169. The partition member 169 is placed between coating material bags adjacent to each other. The partition member 169 partitions areas to place the plurality of coating material, so as to separate them from each other. The coating material bags partitioned by the partition member 169 have different maximum volumes.

In the present embodiment, the coating material cartridge 160 includes a coating material bag 161 and a coating material bag 162. The partition member 169 divides a space in the capsule 20 into a plurality of regions having different volumes. Maximum volumes of the coating material bag 161 and the coating material bag 162 can be prescribed in advance so as to be substantially proportional to spaces partitioned by the partition member 169.

Shapes of the coating material bag 161 and the coating material bag 162 after expansion can be prescribed in advance to follow predetermined shapes. The shapes can be prescribed to follow shapes of those spaces in the capsule 20 which are partitioned by the partition member 169.

It is preferable that the shapes allow the expanded coating material bag 161 and the expanded coating material bag 162 to make close contact with a wall surface of the partition member 169 and an inner wall of the capsule 20 to such an extent that they do not stick to each other and come off from each other.

In the present embodiment, the coating material bag 161 and the coating material bag 162 expand in the capsule 20 to predetermined limits. One factor to determine the predetermined limits is sizes or volumes of those spaces in the capsule 20 which are partitioned by the partition member 169.

In a preferred embodiment, the capsule 20 and the partition member 169 are separate members. In this case, a position or a shape of the partition member 169 in the capsule 20 can be changed freely or optionally. In view of this, a ratio between the volumes of the coating material bag 161 and the coating material bag 162 in the cartridge 160 can be changed freely. Accordingly, amounts of coating materials to be stored in the coating material bag 161 and the coating material bag 162 can be changed.

For example, as illustrated in FIG. 12, that wall surface of the partition member 169 which is placed on a connection-portion-25 side may be placed so as to be distanced from the connecting portion 25. At this time, a space on the connecting-portion-25 side is large. Because of this, the coating material bag 161 can expand larger than the first coating material bag 11 (the first embodiment). Accordingly, the coating material bag 161 can store a larger amount of the coating material than the first coating material bag 11. This allows the first path 15 to send a larger amount of the coating material 1.

Further, as illustrated in FIG. 13, that wall surface of the partition member 169 which is placed on a connection-portion-26 side may be placed so as to be distanced from the connecting portion 26. At this time, reversely to the above, the coating material bag 162 can store a larger amount of the coating material therein, thereby allowing the second path 16 to send a larger amount of the second coating material 2.

A method to change the position of the wall surface of the partition member 169 is not limited in particular. As an example, there is a method to place the position of the partition member 169 in an off-center manner so as to be closer to either of the connection portions as illustrated in FIGS. 12, 13.

Further, the partition member 169 may have a shape having a recessed surface on a side on which a space is to be made large. A shape of the recessed surface may be a curved shape, a bent shape, or a hollow shape. The shape is not particularly limited, provided that the shape does not cause the partition member 169 to be deformed or broken due to a pressure of the coating material bag storing the coating material therein.

A charging pressure often reaches 0.4 to 0.8 MPa. In consideration of a pressure receiving area, for example, it is assumed that the partition member 169 receives a pressure of 8 kgf/cm$^2$ and thus the partition member 169 receives a force of 1500 kgf. In view of this, the curved shape, for example, is preferable to increase strength of the partition member 169.

Such a recessed surface may be parallel to an up-down direction in the figure. Here, it is assumed that the capsule 20 has a cylindrical portion or an elliptical tubular portion having an opening that makes contact with the controlling portion 30. In such a case, the recessed surface of the partition member 169 may be parallel to a central axis for the cylindrical portion or the elliptical tubular portion.

Further, if the capsule 20 has the cylindrical portion, an interval between those sides of the partition member 169 which make contact with the inner wall of the capsule 20 may be substantially the same as an inside diameter of the cylindrical portion. Further, if the capsule 20 has the elliptical tubular portion, the interval between those sides of the partition member 169 which make contact with the inner wall of the capsule 20 may be substantially the same as an inside diameter of the elliptical tubular portion.

In the above configuration, the partition member 169 does not move in the capsule 20 to come closer to or separate from either of the coating material bags. That is, in FIGS. 12, 13, the partition member 169 hardly moves laterally or does not move laterally in the capsule 20. In view of this, the partition member 169 does not prevent the coating material bag 161 or 162 from storing a predetermined amount of the first coating material 1 or the second coating material 2.

[Coating Material Charging Operation and Coating Operation]

In the present embodiment, respective coating materials having different colors or compositions are charged into two or more coating-material containers at different amounts. In view of this, it is preferable to use the above charging device. The following describes an example using the charging device.

As illustrated in FIGS. 12, 13, in the coating material cartridge 160, the coating material bags, the capsule 20, the pressing fluid, and the pressing fluid path are used. The partition member 169 divides a space in the capsule 20 into a plurality of spaces having different volumes. Here, charging amounts of respective coating materials with respect to respective coating material bags are determined in advance. After the respective coating materials are charged, the coating materials are applied similarly to the first embodiment.

[Effects of Present Embodiment]

At the time when a layer having a large thickness is applied, it is possible to reduce occasions where the coating material in the cartridge becomes insufficient. In such a case, recharging of the coating material is not necessary. In view of this, the electrostatic coating device or the coating method of the present embodiment contributes to shortening of working hours and improvement of entire working efficiency. Further, in the present embodiment, the charging amount of the coating material can be determined according to the position or the shape of the partition member.

Due to the above feature, it is possible to control a ratio between volumes of the coating-material containers without any special control device. In other words, it is possible to change a charging ratio between the first coating material 1 and the second coating material 2 without any special control device.

3. Third Embodiment

The following mainly deals with differences from the first embodiment. Further, a constituent equivalent to that in the first and second embodiments has the same reference sign as in the first and second embodiments, and redundant explanation is omitted.

[Problem to be Solved by the Invention]

The problem is the same as in the second embodiment. In the second embodiment, charging amounts of the coating materials with respect to the respective coating-material containers are prescribed by the position of the partition member 169.

In the above case, in order that the ratio in volume between the coating-material containers is set to a desired ratio, the partition member 169 and the capsule 20 having an appropriate shape or positional relationship are required. In a case where they do not have an appropriate shape or positional relationship, it is difficult to control the charging amounts of the respective coating materials in particular.

[Summary and Effects of Present Embodiment]

An electrostatic coating system according to the present embodiment is described below with reference to FIGS. 12, 13. The electrostatic coating system further includes a coating material cartridge 160 and a removable charging device (not shown entirely). The charging device is directly or indirectly connected to a flow meter 158, 159 or 182, or includes the flow meter.

In the present embodiment, respective coating materials are charged into two or more coating-material containers at different amounts. In the present embodiment, the charging amounts of the respective coating materials can be controlled in particular without depending on the shape or positional relationship of the partition member 169 and the capsule 20.

A volume of the coating material to be stored in the coating material bag is limited or prescribed to a maximum volume of the coating material bag. The volume is also limited or prescribed by the inner wall of the capsule 20 or the wall surface of the partition member 169. In the present embodiment, even if the volume of the coating material to be charged does not reach the limited or prescribed volume, it is possible to stop the charging of the coating material.

Further, similarly to the second embodiment, at the time when a layer having a large thickness is applied, it is possible to reduce occasions where the coating material in the cartridge becomes insufficient. In such a case, recharging of the coating material is not necessary. In view of this, the electrostatic coating device or the coating method of the present embodiment contributes to shortening of working hours and improvement of entire working efficiency.

[Electrostatic Coating System of Aspect 1]

Initially, Aspect 1 is described with reference to FIG. 12. In one aspect according to the present embodiment, an electrostatic coating system further includes a coating material cartridge 160 and a removable charging device (not shown). The charging device includes a main path 151 connectable to a common path 31. The main path 151 is connected to a color change valve 170.

The color change valve 170 is connected to a plurality of flow meters. The color change valve 170 includes connecting portions 171 to 176. The connecting portion 171 is connected to a conduit line 153. The conduit line 153 is connected to a flow meter 158. The flow meter 158 is connected to a conduit line 154. The conduit line 154 is connected to a coating material tank (not shown).

The connecting portion 172 is connected to a conduit line IS. The conduit line 155 is connected to a flow meter 159. The flow meter 159 is connected to a conduit line 156. The conduit line 156 is connected to a coating material tank (not shown). The connecting portions 173 to 176 may be connected to flow meters similarly. In the present aspect, the plurality of flow meters is connected to tanks having different coating materials, respectively.

The color change valve 170 includes an air connecting portion 165 and a cleaning agent connecting portion 166. The color change valve 170 receives the air from the air connecting portion 165. The color change valve 170 receives a cleaning agent from the cleaning agent connecting portion 166.

[Coating Material Charging Operation of Aspect 1]

At the time of charging of coating materials, the main path 151 in the charging device connected to the coating material cartridge 160 is used as described above. Each of the coating materials is sent to the common path 31 via the color change valve 170 and the main path 151 sequentially. The coating materials of different colors flow into the color 3 change valve 170.

A first coating material 1 moves into the coating material bag 161 via the coating-material tank, the conduit line 154, the flow meter 158, the conduit line 153, the color change valve 170, the main path 151, the common path 31, a first valve 13, and a first path 15. In the present embodiment, a charging amount of the first coating material 1 is to controlled by use of the flow meter 158 on a first-coating-material-1 side.

A second coating material 2 moves into the coating material bag 162 via the coating-material tank, the conduit line 156, the flow meter 159, the conduit line 155, the color change valve 170, the main path 151, the common path 31, a second valve 14, and a second path 16. In the present embodiment, a charging amount of the second coating material 2 is controlled by use of the flow meter 159 on a second-coating-material-2 side.

By measuring a flow rate of each of the coating materials of different colors, the charging amount of each of the coating materials with respect to each of the coating material bags is controlled to a value determined in advance. Note that sizes and maximum capacities of the coating material bag 161 and the coating material bag 162 are not limited in particular, in the present embodiment. In the meantime, in order to effectively utilize the volume of the coating material cartridge 160 or the capsule 20, a position to provide the partition member 169 may be set in an off-center manner like the second embodiment.

As illustrated in FIG. 12, in Aspect 1, that wall surface of the partition member 169 which is placed on a connection-portion-25 side is placed so as to be distanced from the connecting portion 25. This makes it possible to change a ratio in volume between the coating-material containers so as not to make the volume of the coating material cartridge 160 or the capsule 20 unused.

[Effects and Modification of Aspect 1]

In the present aspect, a charging ratio between the first coating material 1 and the second coating material 2 can be changed without depending on the shape or positional relationship of the partition member 169 and the capsule 20. As a modification of the present aspect, instead of each of the flow meters, a predetermined amount of the coating material may be measured by a piston and sent to the main path 151.

[Electrostatic Coating System of Aspect 2]

Next will be described Aspect 2 with reference to FIG. 13. The following mainly deals with differences from Aspect 1. A color change valve 170 may not be connected to the flow meters. In the present aspect, the color change valve 170 is connected to tanks having different coating materials.

A charging device (not shown) includes a pressing fluid flow path 167 including conduit lines 181, 183. The pressing fluid flow path 167 is connected to a discharge pressing fluid path 17 of a coating material cartridge 160. More specifically, the conduit line 181 is connected to a connecting portion 23. A pressing fluid is preferably solvent ED.

The pressing fluid flow path 167 of the charging device has a flow meter 182 or is connected to the flow meter 182. As illustrated in FIG. 13, the conduit line 181 is connected to the flow meter 182. The flow meter 182 is connected to the conduit line 183. The conduit line 183 is connected outside the charging device.

[Coating Material Charging Operation of Aspect 2]

A first coating material 1 moves into a coating material bag 161 via a coating-material tank, the color change valve 170, a main path 151, a common path 31, a first valve 13, and a first path 15. When the first coating material 1 is charged into the coating material bag 161, a pressing fluid in a capsule 20 is discharged from the connecting portion 23.

A second coating material 2 moves into a coating material bag 162 via a coating-material tank, the color change valve 170, the main path 151, the common path 31, a second valve 14, and a second path 16. When the second coating material 2 is charged into the coating material bag 162, the pressing fluid in the capsule 20 is discharged from the connecting portion 23.

The flow meter 182 measures a volume of the pressing fluid passing through the flow meter 182. When the volume of the pressing fluid passing through the flow meter 182 reaches a predetermined value, the color change valve 170 blocks or closes a charging path of the first coating material 1. Instead of the color change valve 170, another valve in the charging path of the first coating material 1 may block or close the charging path of the first coating material 1.

[Effects and Modification of Aspect 2]

In the present embodiment, charging amounts of the first coating material 1 and the second coating material 2 are controlled by use of the flow meter 182. Accordingly, differently from Aspect 1 that requires a flow meter for each coating material, it is possible to control the charging amount of each coating material with one flow meter.

In the present aspect, a charging ratio between the first coating material 1 and the second coating material 2 can be changed without depending on the shape or positional relationship of the partition member 169 and the capsule 20. The flow meter 182 may be provided in the pressing fluid path 17 as a modification of the present aspect.

4. Modification of Embodiment

Note that the present invention is not limited to the above embodiments, and various modifications can be made within a range which does not deviate from a gist of the present invention. The present embodiments deal with two-layer coating with two colors as an example. In the meantime, one-layer coating with one color may be performed twice by spraying the coating materials stored in the coating material cartridge to different coating objects.

Further, three sets of a coating-material container, an individual path, a valve, and members necessary for operating them may be provided in a coating material cartridge. According to such a method, three-layer coating with three colors can be performed. Further, by increasing the number of sets of the coating-material container, the individual path, the valve and other necessary members, it is possible to perform multilayer coating with multiple colors.

In a case where a plurality of layers is coated with a plurality of colors, used amounts of coating materials are different from each other according to thicknesses of respective layers. In this case, by changing charging amounts of respective coating materials, it is possible to perform coating of respective colors in succession without recharging.

The change of the charging amounts may be performed in a similar manner to the second embodiment, such that the charging amounts of the respective coating materials may be changed by changing a position/shape of the partition member. Further, in a similar manner to the third embodiment, the charging amounts of the respective coating materials may be changed by providing the flow meter in the charging paths of the coating materials or the pressing fluid path.

In the above embodiments, the valves are provided, but another member except the valves may be provided if the another member can open and close the conduit line. For example, an individual path is formed of a flexible material such as a rubber tube, and the conduit line may be opened and closed by a pin or a clamp that pinches this. Further, in the present embodiment, the check valve is provided so as to prevent reverse flow to the cleaning circuit, but that valve or the like for the cleaning circuit which can control opening and closing may be provided separately.

In the above embodiments, the coating-material container is a coating material bag, but a shape and a material thereof is not limited particularly provided that the container can transmit a pressure of the pressing fluid to a coating material and a volume thereof is changed according to an amount of a coating material retained therein.

Further, in order to prevent mixing of a plurality of coating materials, a closed container that does not have leakage of the coating material to any places other than a path to be used for charging or sending of the coating material is preferable. For example, the coating-material container may be constituted by a piston and a cylinder. Further, the coating-material container may be formed by connecting an opening of a coating material bag to a cylinder.

The coating material cartridge of the above embodiments includes a common capsule to contain the coating material bags, but may include a capsule for each coating material bag. In a case where the coating material cartridge includes a capsule for each coating material, one or more pressing fluid paths may be provided in each capsule. Further, the coating material cartridge may have an anchor for fixing a position of each coating material bag in the capsule, instead of the partition member.

In the present embodiment, the alternative path is connected to the main path in the charging device, but the alternative path may receive the cleaning agent independently from the main path. Further, the cleaning circuit may be directly connected to the discharge path not via the common circuit or the main path, so that the cleaning agent moves through the main path, the common path, the cleaning circuit, and the discharge path in this order.

In such a case, the alternative path may not be provided. In this case, the cleaning agent moves in a direction reverse to that in the above embodiment in the coating material cartridge, so that the check valve is preferably a valve that can control opening and closing as described above.

In the present embodiments, the controlling portion includes the pressing fluid paths for injection and discharge, but may further include more pressing fluid paths. Further, the controlling portion may include one pressing fluid path. In such a case, that pressing fluid flow path of the charging device which is connectable to the one pressing fluid path is preferably connected to a pressing fluid pump. Further, it is preferable for the pressing fluid pump to control both inflow and outflow.

The electrostatic coating device does not need to use up the coating material charged in each of the coating-material containers. The electrostatic coating device can regulate an amount to use for coating and an unused amount per coating material. Note that leaving the coating material in the coating-material container easily leads to a decrease in working efficiency in consecutive working steps. In view of this, it is preferable to control the charging amounts of respective coating material as described in the second and third embodiments.

The present embodiments show the electrostatic coating device and the coating method with a vehicle body of an automobile as an example, but an object to be coated is not limited to the automobile. For example, the present embodiments may be applied to coating of an aircraft, a household electrical appliance, an electronic product, an office appliance, a construction material, and the like.

This application claims priority based on Japanese Patent Application No. 2012-283028 filed on Dec. 26, 2012, the entire contents of which are hereby incorporated by reference.

DESCRIPTION OF THE REFERENCE NUMERALS

1 . . . first coating material, 2 . . . second coating material, 7 to 8 . . . coating material, 9 . . . robot, 10 . . . coating material cartridge, 11 . . . first coating material bag, 12 . . . second coating material bag, 13 . . . first valve, 14 . . . second valve. 15 . . . first path, 16 . . . second path, 17 . . . pressing fluid path, 18 . . . pressing fluid path, 19 . . . partition member, 20 . . . capsule, 21 . . . connecting portion, 23 to 26 . . . connecting portion, 30 . . . controlling portion, 31 . . . common path, 32 . . . check valve, 33 . . . cleaning circuit, 34 . . . connecting portion, 35 . . . connecting portion, 37 . . . first pilot air path, 38 . . . second pilot air path, 51 to 52 . . . pressure, 53 . . . outflow direction, 54 . . . inflow direction, 55 . . . pressure, 60 . . . charging device, 61 . . . first tank, 62 . . . second tank, 63 to 65 . . . tank, 67 . . . pressing fluid flow path, 70 . . . color change valve, 71 to 75 . . . connecting portion, 76 . . . junction portion, 77 . . . valve portion, 80 . . . pipe portion, 81 . . . main path, 83 . . . alternative path, 84 . . . discharge path, 87 . . . first charging air path, 88 . . . second charging air path, 90 . . . coating machine, 91 . . . sending path, 92 . . . first coating air path, 93 . . . second coating air path, 94 . . . rotary atomizing head, 95 . . . pressing fluid flow path, 97 . . . support portion, 98 . . . coating portion, 99 . . . main body, 100 . . . vehicle body, 101 to 104 . . . coating film, 105 . . . vehicle body, 106 . . . coating film, 109 . . . coating material cartridge, 110 . . . coating material cartridge, 139 to 140 . . . coating material cartridge, 151 . . . main path, 153 to 156 . . . conduit line, 158 to 159 . . . flow meter, 160 . . . coating material cartridge, 161 to 162 . . . coating material bag, 165 . . . air connecting portion, 166 . . . cleaning agent connecting portion, 167 . . . pressing fluid flow path, 169 . . . partition member, 170 . . . color change valve, 171 to 176 . . . connecting portion, 181 . . . conduit line, 182 . . . flow meter, 183 . . . conduit line

The invention claimed is:

1. An electrostatic coating method comprising:

respectively retaining coating materials in coating-material containers in a coating material cartridge, and changing the coating materials by a valve at a time of sending of each of the coating materials;

sending each of the coating materials from the coating material cartridge to a coating machine via a common path in an electrostatic coating device according to the change;

performing multilayer coating by the electrostatic coating device, wherein the multilayer coating is performed by applying one of the retained coating materials and then applying another one of the retained coating materials;

charging coating materials having different colors or compositions into two or more coating-material containers at different amounts;

providing, in the coating material cartridge, coating material bags corresponding to the coating-material containers and having different maximum volumes, a capsule containing the coating material bags and a partition member provided between the coating material bags, a pressing fluid, and a pressing fluid path connected to an inner space provided inside the capsule and outside the coating material bags;

dividing a space in the capsule by the partition member into a plurality of spaces having different volumes so as to determine a charging amount of each of the coating materials with respect to a corresponding one of the coating material bags in advance;

filling the inner space with the pressing fluid; and sending each of the coating materials from the coating material cartridge to the coating machine by pressing each of the coating material bags with the pressing fluid.

2. An electrostatic coating method comprising:

respectively retaining coating materials in coating-material containers in a coating material cartridge, and changing the coating materials by a valve at a time of sending of each of the coating materials;

sending each of the coating materials from the coating material cartridge to a coating machine via a common path in an electrostatic coating device according to the change;

performing multilayer coating by the electrostatic coating device, wherein the multilayer coating is performed by applying one of the retained coating materials and then applying another one of the retained coating materials;

charging coating materials having different colors or compositions into two or more coating-material containers at different amounts;

providing, in a charging device connected to the coating material cartridge, a main path connected to the common path and a color change valve;

sending each of the coating materials to the common path via the color change valve and the main path; and controlling a charging amount of each of the coating materials with respect to a corresponding one of coating material bags corresponding to the coating-material containers to a value determined in advance by measuring a flow rate of each of the coating materials of different colors to flow into the color change valve.

3. An electrostatic coating method comprising:

respectively retaining coating materials in coating-material containers in a coating material cartridge, and changing the coating materials by a valve at a time of sending of each of the coating materials;

sending each of the coating materials from the coating material cartridge to a coating machine via a common path in an electrostatic coating device according to the change;

performing multilayer coating by the electrostatic coating device, wherein the multilayer coating is performed by applying one of the retained coating materials and then applying another one of the retained coating materials;

charging coating materials having different colors or compositions into two or more coating-material containers at different amounts;

providing, in the coating material cartridge, coating material bags corresponding to the coating-material containers, a capsule containing the coating material bags, and a pressing fluid path for discharge connected to an inner space inside the capsule and outside the coating material bags;

providing, in a charging device connected to the coating material cartridge, a pressing fluid flow path connected to the pressing fluid path for discharge;

filling the inner space with a pressing fluid;

controlling a charging amount of each of the coating materials with respect to a corresponding one of the coating material bags to a value determined in advance by measuring a flow rate, in the pressing fluid flow path, of the pressing fluid discharged outside in a course of charging each of the coating materials into the corresponding one of the coating material bags; and sending each of the coating materials outside the coating material cartridge by pressing each of the coating material bags with the pressing fluid.

* * * * *